US012808542B2

(12) United States Patent
Nath et al.

(10) Patent No.: US 12,808,542 B2
(45) Date of Patent: Nov. 24, 2026

(54) TURBINE ENGINE INCLUDING A COMBUSTOR

(71) Applicant: General Electric Company, Schenectady, NY (US)

(72) Inventors: Hiranya Nath, Bengaluru (IN); Michael A. Benjamin, Cincinnati, OH (US); Richard W. Stickles, Loveland, OH (US); Clayton S. Cooper, Loveland, OH (US); Steven C. Vise, Loveland, OH (US); Ranganatha Narasimha Chiranthan, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 255 days.

(21) Appl. No.: 18/326,665

(22) Filed: May 31, 2023

(65) Prior Publication Data

US 2024/0401807 A1 Dec. 5, 2024

(51) Int. Cl.
*F23R 3/42* (2006.01)
*F23R 3/00* (2006.01)
(Continued)

(52) U.S. Cl.
CPC ..... *F23R 3/42* (2013.01); *F23R 3/002* (2013.01); *F23R 3/14* (2013.01); *F23R 3/346* (2013.01); *F23R 2900/00015* (2013.01)

(58) Field of Classification Search
CPC .... F23R 3/346; F23R 3/34; F23R 3/42; F23R 3/50; F23R 3/52; F23R 2900/00015; F23R 3/002; F23R 3/14
See application file for complete search history.

(56) References Cited

U.S. PATENT DOCUMENTS 4,455,839 A * 6/1984 Wuchter ..... F23R 3/58 60/737
4,982,570 A 1/1991 Waslo et al.
(Continued)

FOREIGN PATENT DOCUMENTS

CN 116972414 A * 10/2023 ..... F23R 3/28

OTHER PUBLICATIONS

English translation of CN116972414A (Year: 2023).*

*Primary Examiner* — Thomas P Burke
(74) *Attorney, Agent, or Firm* — Venable LLP; Duarte Y Ho; Michele V. Frank

(57) ABSTRACT

A turbine engine includes a combustor having a main combustion chamber, an annular dome positioned at a first angle α with respect to a longitudinal centerline axis of the combustor, and a secondary combustion chamber. The secondary combustion chamber is defined by a portion of the annular dome and an aft wall positioned at a second angle β with respect to the longitudinal centerline axis. A pilot mixer is disposed through the annular dome and injects a pilot mixer fuel-air mixture at a pilot mixer fuel-air mixture angle into the main combustion chamber and generates a first recirculation zone. A main mixer is disposed through the aft wall or the annular dome at the secondary combustion chamber. The main mixer injects a main mixer fuel-air mixture at a main mixer fuel-air mixture angle into the secondary combustion chamber to produce combustion gases and generates a second recirculation zone.

20 Claims, 7 Drawing Sheets

(51) Int. Cl.
*F23R 3/14* (2006.01)
*F23R 3/34* (2006.01)

(56) References Cited

U.S. PATENT DOCUMENTS 5,261,239 A * 11/1993 Barbier ..... F23R 3/04 60/731
5,295,354 A * 3/1994 Barbier ..... F23R 3/54 60/731
5,619,855 A * 4/1997 Burrus ..... F23R 3/20 60/737
5,791,148 A * 8/1998 Burrus ..... F02C 7/224 60/749
6,286,298 B1 9/2001 Burrus et al.
6,295,801 B1 * 10/2001 Burrus ..... F23R 3/12 60/737
6,360,525 B1 * 3/2002 Senior ..... F23R 3/12 60/776
6,481,209 B1 11/2002 Johnson et al.
6,672,072 B1 * 1/2004 Giffin, III ..... F01D 25/12 60/806
6,951,108 B2 10/2005 Burrus et al.
7,779,866 B2 8/2010 Grammel, Jr. et al.
7,849,693 B2 12/2010 Bainville et al.
8,272,219 B1 * 9/2012 Johnson ..... F23R 3/50 60/750
8,549,862 B2 * 10/2013 Kendrick ..... F23R 3/286 60/737
9,068,748 B2 6/2015 Hoke
9,068,751 B2 6/2015 Snyder
9,797,601 B2 10/2017 Cheung et al.
9,958,162 B2 5/2018 Dai et al.
10,060,629 B2 8/2018 Kim et al.
10,330,320 B2 6/2019 Snyder, III
10,330,321 B2 6/2019 Snyder
10,823,422 B2 11/2020 Johnson et al.
10,976,053 B2 4/2021 Boardman et al.
11,073,286 B2 7/2021 Boardman et al.
11,262,073 B2 * 3/2022 Duncan ..... F23R 3/346
12,130,016 B1 * 10/2024 Nath ..... F23R 3/12
2002/0112482 A1 * 8/2002 Johnson ..... F23R 3/16 60/776
2004/0011058 A1 * 1/2004 Baudoin ..... F23R 3/34 60/752
2004/0103663 A1 * 6/2004 Haynes ..... F23R 3/58 60/737
2008/0134684 A1 * 6/2008 Umeh ..... F02C 9/46 60/39.281
2011/0185735 A1 * 8/2011 Snyder ..... F23R 3/346 60/746
2016/0116169 A1 4/2016 Hyland et al.
2016/0123596 A1 5/2016 Hoke et al.
2016/0258627 A1 9/2016 Cheung et al.
2016/0320063 A1 11/2016 Dai et al.
2017/0363004 A1 12/2017 Xu
2018/0094590 A1 4/2018 Proscia
2018/0094814 A1 4/2018 Proscia
2018/0094817 A1 4/2018 Proscia
2018/0156463 A1 6/2018 Dai et al.
2018/0156464 A1 6/2018 Dai et al.
2018/0163629 A1 6/2018 Proscia
2019/0017441 A1 * 1/2019 Venkatesan ..... F23R 3/002
2019/0113235 A1 * 4/2019 Johnson ..... F23R 3/12
2021/0277835 A1 * 9/2021 Madden ..... F23R 3/346
2022/0356846 A1 * 11/2022 Overman ..... F02C 7/232
2023/0280034 A1 * 9/2023 Overman ..... F23R 3/50 60/737
2023/0280035 A1 * 9/2023 Depperschmidt ..... F23R 3/50 60/39.76
2023/0400187 A1 * 12/2023 Ganiger ..... F23R 3/06

* cited by examiner

TURBINE ENGINE INCLUDING A COMBUSTOR

TECHNICAL FIELD

The present disclosure relates generally to turbine engines including combustors.

BACKGROUND

A turbine engine generally includes a fan and a core section arranged in flow communication with one another. A combustor is arranged in the core section to generate combustion gases for driving a turbine of the turbine engine.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Figure 1:
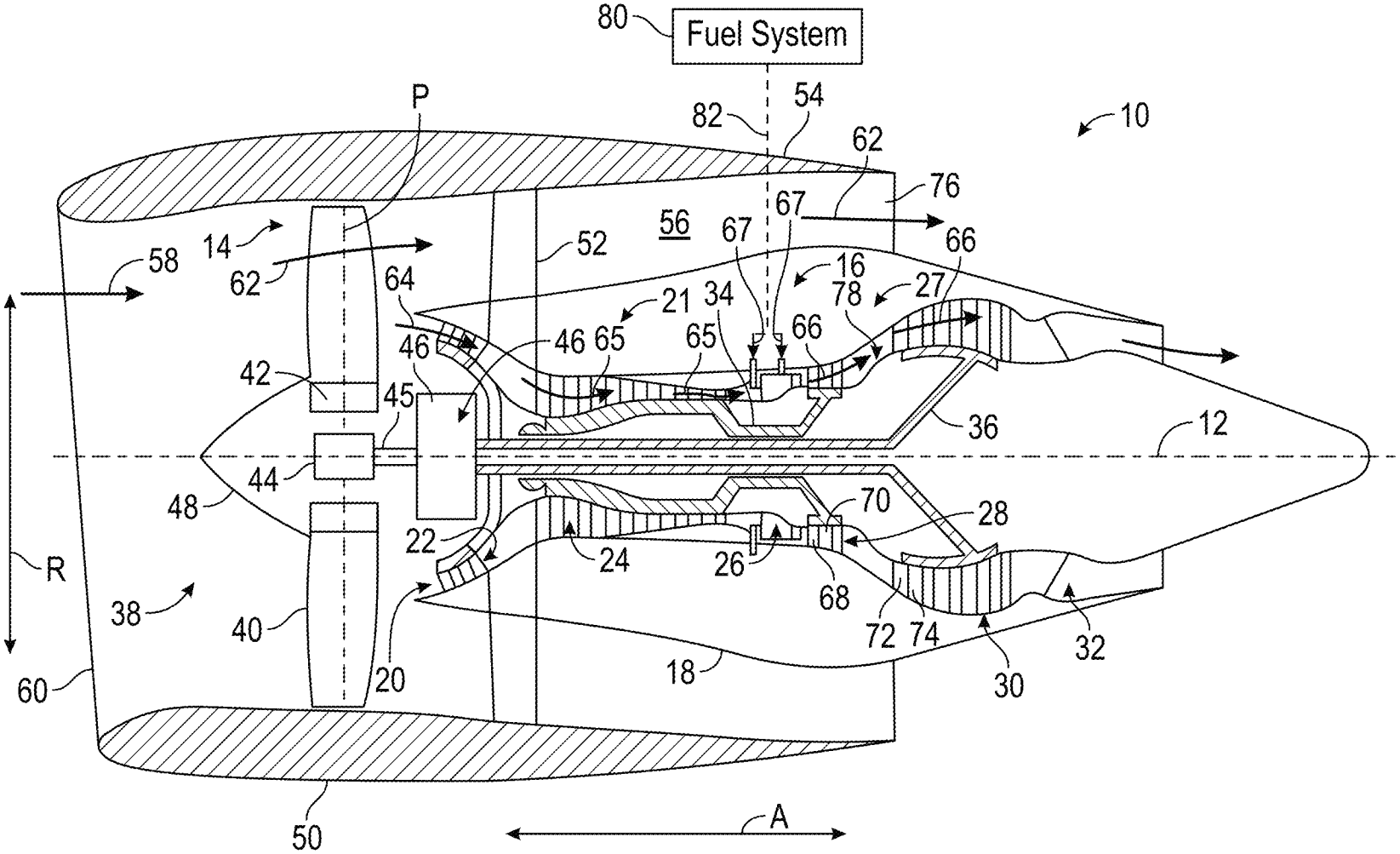
FIG. 1 is a schematic cross-sectional diagram of a turbine engine, taken along a longitudinal centerline axis of the turbine engine, according to the present disclosure.

Additional features, advantages, and embodiments of the present disclosure are set forth or apparent from a consideration of the following detailed description, drawings, and claims. Moreover, both the foregoing summary of the present disclosure and the following detailed description are exemplary and intended to provide further explanation without limiting the scope of the disclosure as claimed.

Various embodiments of the present disclosure are discussed in detail below. While specific embodiments are discussed, this is done for illustration purposes only. A person skilled in the relevant art will recognize that other components and configurations may be used without departing from the spirit and the scope of the present disclosure.

As used herein, the terms "first," "second," and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "forward" and "aft" refer to relative positions within a turbine engine or vehicle, and refer to the normal operational attitude of the turbine engine or vehicle. For example, with regard to a turbine engine, forward refers to a position closer to an engine inlet and aft refers to a position closer to an engine nozzle or exhaust.

As used herein, the terms "low," "mid" (or "mid-level"), and "high," or their respective comparative degrees (e.g., "lower" and "higher", where applicable), when used with compressor, turbine, shaft, fan, or turbine engine components, each refers to relative pressures, relative speeds, relative temperatures, and/or relative power outputs within an engine unless otherwise specified. For example, a "low power" setting defines the engine configured to operate at a power output lower than a "high power" setting of the engine, and a "mid-level power" setting defines the engine configured to operate at a power output higher than a "low power" setting and lower than a "high power" setting. The terms "low," "mid" (or "mid-level") or "high" in such aforementioned terms may additionally, or alternatively, be understood as relative to minimum allowable speeds, pressures, or temperatures, or minimum or maximum allowable speeds, pressures, or temperatures relative to normal, desired, steady state, etc., operation of the engine.

The various power levels of the turbine engine detailed herein are defined as a percentage of a sea level static (SLS) maximum engine rated thrust. Low power operation includes, for example, less than thirty percent (30%) of the SLS maximum engine rated thrust of the turbine engine. Mid-level power operation includes, for example, thirty percent (30%) to eighty-five (85%) of the SLS maximum engine rated thrust of the turbine engine. High power operation includes, for example, greater than eighty-five percent (85%) of the SLS maximum engine rated thrust of the turbine engine. The values of the thrust for each of the low power operation, the mid-level power operation, and the high power operation of the turbine engine are exemplary only, and other values of the thrust can be used to define the low power operation, the mid-level power operation, and the high power operation.

The terms "coupled," "fixed," "attached," "connected," and the like, refer to both direct coupling, fixing, attaching, or connecting, as well as indirect coupling, fixing, attaching, or connecting through one or more intermediate components or features, unless otherwise specified herein.

The singular forms "a," "an," and "the" include plural references unless the context clearly dictates otherwise.

As used herein, the terms "axial" and "axially" refer to directions and orientations that extend substantially parallel to a centerline of the turbine engine. Moreover, the terms "radial" and "radially" refer to directions and orientations that extend substantially perpendicular to the centerline of the turbine engine. In addition, as used herein, the terms "circumferential" and "circumferentially" refer to directions and orientations that extend arcuately about the centerline of the turbine engine.

Here and throughout the specification and claims, range limitations are combined, and interchanged. Such ranges are identified and include all the sub-ranges contained therein unless context or language indicates otherwise. For example, all ranges disclosed herein are inclusive of the endpoints, and the endpoints are independently combinable with each other.

Combustors for turbine engines, such as turbine engines for aircraft, ignite fuel and air mixtures to produce combustion gases, which in turn drive one or more turbines of the turbine engine, thereby rotating one or more loads (e.g., a fan, a propeller, etc.). Air pollution concerns have led to stricter combustion emissions standards. Such standards regulate the emission of nitrogen oxide (NOx), non-volatile particulate matter (nvPM), as well as other types of exhaust emissions, from the turbine engine. The nvPM includes, for example, soot, smoke, or the like. Generally, NOx is formed during the combustion process due to high flame temperatures in the combustor. Turbine engine design tradeoffs are necessary to meet requirements for noise, emissions, fuel burn, cost, weight, and performance. As temperatures in the combustor increase, NOx generation increases due to the higher temperatures. In turbine engine design, balancing a reduction in NOx emissions, nvPM emissions, $CO_2$, and noise, while achieving improved engine performance, is difficult. For example, combustor design changes to achieve lower emissions must not impact the ability of the combustion system to satisfy performance and certification requirements throughout the operating cycle of the aircraft. Further, high bypass ratio turbine engines (e.g., bypass ratios greater than 9.0) require high fuel-air ratios and need multiple fuel-staging to meet NOx requirements.

Variations of two combustor architectures are used in turbine engine design to balance operational and environmental requirements: a rich-quench lean (RQL) combustor and a lean burn combustor. The RQL combustor operates as a fuel-rich (e.g., excess fuel) mixture in a front-end primary zone that is directly downstream of the fuel injector and the swirler and provides flame stability over the range of combustor operation. As the fuel-rich mixture moves axially in the combustor, air jets are used to help close the primary zone recirculation zone and to provide additional air to continue reactions and also to quench the combustion gas to a lean mixture to reduce NOx emissions and reduce the highest temperature before the mixture exits the combustor. For example, the additional air from the air jets increases the amount of air in the fuel-air mixture changing the mixture from fuel-rich to fuel-lean. RQL combustors produce great amounts of soot in the fuel-rich primary zone, but NOx is reduced due to temperatures being low for fuel-rich mixtures. A rapid RQL quench zone design is needed in RQL combustors to balance a reduction of combustor hot spots and time at a temperature at which NOx is formed, while providing adequate temperature and time to burn out the soot and the nvPM formed in the primary zone.

Lean burn combustors avoid the high NOx formation zone resulting from high temperatures by starting lean and remaining lean at higher power outputs of the turbine engine. A small, fuel-rich flame, referred to as a pilot flame, is used that operates with a lower percentage of the total fuel and stabilizes the flame when in a lean burning mode. The pilot provides all of the fuel during low-power operation and part-power operation to maintain improved combustion efficiencies, and a main fuel circuit is opened to produce a main flame for higher power operation or mid-level power operation. Thus, the flame during the mid-level power operation and/or during the higher power operation includes the pilot flame and the main flame. A lean burn design provides all of the mixing in the front-end (e.g., the upstream end) of the combustor, which helps to reduce nvPM emissions by remaining fuel-lean and avoiding large combustor volumes of fuel-rich, high nvPM-producing zones in the combustor. When operating on pilot only flow at lower powers, the lean burn combustor produces non-zero nvPM as the pilot flame is quenched by the main air flow, similar to the RQL combustor.

As detailed above, there are tradeoffs in balancing NOx emissions, nvPM emissions, and carbon monoxide (CO) and unburned hydrocarbon (UHC) emissions in the combustion chamber. NOx is produced at high engine power levels, and the NOx is produced in the post-flame region of the combustion chamber, is temperature driven, and is time at temperature driven. For example, a greater amount of NOx is produced at higher temperatures and longer times at temperature. Current turbine engines control NOx emissions by reducing peak combustor temperatures and combustor residence time at those high temperatures. Reducing combustor residence time and combustor volume and length have the added benefit of reduced engine weight. For short combustor residence times and low combustion temperatures where NOx formation is low, however, CO and UHC emissions are higher due to incomplete combustion, and the combustor liner cooling air during low power ground operations can quench reactions of CO and UHC. Fuel-rich zones in the combustor form nvPM emissions, and increased time (combustor volume) is needed to oxidize the nvPM before being quenched in the downstream cooler region of the engine after exiting the combustor. Therefore, to balance all emissions requirements, turbine engine designs need an improved fuel and air placement in the dome region, an improved stoichiometry in the combustor, and improved residence time. Some turbine engines utilize leaner mixtures or changes in fuel spray at the upstream end of the combustor to reduce nvPM emissions. Such turbine engines, however, reduce operability and increase NOx emissions and require high fuel-air ratios for advanced thermodynamic cycles. Further, higher fuel-to-air ratios (e.g., greater than 0.031) at take-off are needed in such advanced engine thermodynamic cycles. Current combustor designs that utilize axial staging, traditional trapped vortex cavities, or the like, that utilize lower fuel-to-air ratios (e.g., less than or equal to 0.031) at take-off do not adequately optimize the stoichiometry of the combustor to meet required NOx emission targets when the fuel-to-air ratio is increased to the aforementioned higher values.

Embodiments of the present disclosure provide systems and methods to balance the requirements in turbine engines of low fuel burn and carbon dioxide ($CO_2$) emissions that are achieved with combustor fuel-air ratios, and other pollutant emissions, such as NOx emissions, that increase with temperature increases. Such a reduction in the various types of emissions is difficult to achieve when fuel burn and emissions need to be reduced over an entirety of a mission cycle of the turbine engine of an aircraft. The mission cycle includes low power operation, mid-level power operation, and high power operation. Low power operation includes, for example, engine start, idle, taxiing, and approach. Mid-level power operation includes, for example, cruise. High power operation includes, for example, takeoff and climb.

Embodiments of the present disclosure provide for a multi-staged combustor for low NOx emissions (e.g., at least 50% below the regulations in the eleventh meeting of the Committee on Aviation Environmental Protection (CAEP/11) of the International Civil Aviation Organization (ICAO). For example, the multi-staged combustor includes both radial staging and axial staging of the fuel. The multi-staged combustor includes a main combustion chamber and a first mixing assembly that includes a pilot mixer disposed through an annular dome of the main combustion chamber. The pilot mixer injects fuel and air at an angle with respect to a longitudinal centerline axis of the main combustion chamber. The first mixing assembly is located at the annular dome that is positioned at a forward end (e.g., an upstream end) of the main combustion chamber. The first mixing assembly includes an air swirler that swirls the compressed air and generates a first recirculation zone within the main combustion chamber. The annular dome is angled (e.g., greater than 90° and less than 180° or less than 90° and greater than) 0° with respect to the longitudinal centerline axis such that the pilot mixer injects the fuel and the air at an angle with respect to the longitudinal centerline axis.

The multi-staged combustor also includes a secondary combustion chamber (e.g., a combustion chamber that is smaller than the main combustion chamber) that extends from the annular dome axially aft of the annular dome. The secondary combustion chamber includes a second mixing assembly that produces an auxiliary flame and includes a main mixer. The secondary combustion chamber, and the main mixer, can be located on the outer liner and/or the inner liner of the main combustion chamber. The secondary combustion chamber includes an air swirler and a fuel nozzle such that the main mixer injects the fuel and the air into the secondary combustion chamber to produce a second recirculation zone within the secondary combustion chamber. The combustion gases from the second recirculation zone are injected from the secondary combustion chamber at an area downstream of the first recirculation zone. Accordingly, the present disclosure provides for rich combustion within the main combustion chamber and lean combustion within the secondary combustion chamber. The secondary combustion chamber injects the combustion gases generated in the secondary combustion chamber into the main combustion chamber for flame stability and a reduction in NOx emissions as compared to combustors without the benefit of the present disclosure. Further, the secondary combustion chamber includes a shorter residence time as compared to the main combustion chamber.

The first mixing assembly injects the fuel and the air into the first recirculation zone, the second mixing assembly injects the fuel and the air into the secondary combustion chamber, and the secondary combustion chamber injects the combustion gases into the main combustion chamber in an area that is located axially aft, or axially downstream, of the first recirculation zone. The pilot mixer provides fuel-rich combustion, and the combustion gases from the secondary combustion chamber that are injected downstream of the first recirculation zone provide added flexibility of having lean combustion to reduce NOx emissions further than combustors without the benefit of the present disclosure (e.g., combustors with axial staging only). A portion of the secondary combustion chamber is angled (e.g., greater than 90° and less than 180° or less than 90° and greater than) 0° with respect to the longitudinal centerline axis of the combustion chamber such that the main mixer injects the fuel and the air at an angle with respect to the longitudinal centerline axis. In this way, both the first recirculation zone and the second recirculation zone include an axial vector and a radial vector when the fuel and the air is injected from the pilot mixer or the main mixer, respectively. Thus, the present disclosure provides for radial staging (e.g., provided by the radial vector of the pilot mixer and the main mixer) and axial staging (e.g., provided by the axial vector of the pilot mixer and the main mixer) combined and provides for improved stoichiometric capabilities in the combustor, while reducing NOx emissions, across the entire mission operating cycle of a turbine engine.

The annular dome is a wrapped annular dome such that a portion of the annular dome forms a portion of the secondary combustion chamber. The wrapped annular dome eliminates the flanges and the bolts or the coupling mechanisms of a separate liner and annular dome. Such a wrapped annular dome also helps to reduce air leakages through the flanges of annular domes that are separate from the liner. In some embodiments, the annular dome is a bulkhead dome that is coupled to the outer liner and the inner liner of the main combustion chamber. The pilot mixer injects the fuel and the air axially aftward. The main mixer can be disposed through the secondary combustion chamber to inject the fuel and the air axially forward. In some embodiments, the main mixer is disposed through the secondary combustion chamber to inject the fuel and the air axially aftward. The pilot mixer and the main mixer can be staggered circumferentially or in-line circumferentially about the main combustion chamber. The swirl direction of circumferentially successive pilot mixers can be co-rotating or counter-rotating. The swirl direction of circumferentially successive main mixers can be co-rotating or counter-rotating. The swirl direction of the main mixers can be co-rotating or counter-rotating with the swirl direction of the pilot mixers. The annular dome and/or the outer liner and the inner liner can include one or more combustion air holes for introducing additional air into the first recirculation zone and/or the second recirculation zone for the combustion process. The annular dome and/or the outer liner and the inner liner can include one or more air holes for cooling the annular dome and/or the outer liner and the inner liner.

At a low power engine operation, only the pilot mixer is used to produce a pilot flame. In some embodiments, both the pilot mixer and the main mixer can be used during a low power engine operation and the fuel and the air can be radially staged and axially staged between the pilot mixer and the main mixer for flame stability and/or to avoid lean blowout (LBO). At a mid-power engine operation or a high power engine operation, the pilot mixer and the second main mixer are operational at all operating conditions and the fuel splits and air splits are controlled to achieve combustion efficiency, reduced emissions, and improved operability of the combustor, as compared to combustors without the benefit of the present disclosure. The outer liner and the inner liner can be any shape, with split liner designs. The fuel can be any type of fuel used for turbine engines, such as, for example, JetA, sustainable aviation fuels (SAF) including biofuels, hydrogen-based fuel (H2), or the like.

Referring now to the drawings, FIG. 1 is a schematic cross-sectional diagram of a turbine engine 10, taken along a longitudinal centerline axis 12 of the turbine engine 10, according to an embodiment of the present disclosure. As shown in FIG. 1, the turbine engine 10 defines an axial direction A (extending parallel to the longitudinal centerline axis 12 provided for reference) and a radial direction R that is normal to the axial direction A. In general, the turbine engine 10 includes a fan section 14 and a core turbine engine 16 disposed downstream from the fan section 14.

The core turbine engine 16 depicted generally includes an outer casing 18 that is substantially tubular and defines an annular inlet 20. As schematically shown in FIG. 1, the outer casing 18 encases, in serial flow relationship, a compressor section 21 including a booster or a low pressure (LP) compressor 22 followed downstream by a high pressure (HP) compressor 24, a combustion section 26, a turbine section 27 including a high pressure (HP) turbine 28 followed downstream by a low pressure (LP) turbine 30, and a jet exhaust nozzle section 32. A high pressure (HP) shaft 34 or a spool drivingly connects the HP turbine 28 to the HP compressor 24 to rotate the HP turbine 28 and the HP compressor 24 in unison. A low pressure (LP) shaft 36 drivingly connects the LP turbine 30 to the LP compressor 22 to rotate the LP turbine 30 and the LP compressor 22 in unison. The compressor section 21, the combustion section 26, the turbine section 27, and the jet exhaust nozzle section 32 together define a core air flow path.

For the embodiment depicted in FIG. 1, the fan section 14 includes a fan 38 (e.g., a variable pitch fan) having a plurality of fan blades 40 coupled to a disk 42 in a spaced apart manner. As depicted in FIG. 1, the fan blades 40 extend outwardly from the disk 42 generally along the radial direction R. Each fan blade 40 is rotatable relative to the disk 42 about a pitch axis P by virtue of the fan blades 40 being operatively coupled to an actuation member 44 configured to collectively vary the pitch of the fan blades 40 in unison. The fan blades 40, the disk 42, and the actuation member 44 are together rotatable about the longitudinal centerline axis 12 via a fan shaft 45 that is powered by the LP shaft 36 across a power gearbox, also referred to as a gearbox assembly 46. The gearbox assembly 46 is shown schematically in FIG. 1. The gearbox assembly 46 includes a plurality of gears for adjusting the rotational speed of the fan shaft 45 and, thus, the fan 38 relative to the LP shaft 36.

Referring still to the exemplary embodiment of FIG. 1, the disk 42 is covered by a rotatable fan hub 48 aerodynamically contoured to promote an airflow through the plurality of fan blades 40. In addition, the fan section 14 includes an annular fan casing or a nacelle 50 that circumferentially surrounds the fan 38 and/or at least a portion of the core turbine engine 16. The nacelle 50 is supported relative to the core turbine engine 16 by a plurality of circumferentially spaced outlet guide vanes 52. Moreover, a downstream section 54 of the nacelle 50 extends over an outer portion of the core turbine engine 16 to define a bypass airflow passage 56 therebetween.

During operation of the turbine engine 10, a volume of air 58 enters the turbine engine 10 through an inlet 60 of the nacelle 50 and/or the fan section 14. As the volume of air 58 passes across the fan blades 40, a first portion of air 62 is directed or routed into the bypass airflow passage 56, and a second portion of air 64 is directed or is routed into the upstream section of the core air flow path, or, more specifically, into the annular inlet 20 of the LP compressor 22. The ratio between the first portion of air 62 and the second portion of air 64 is commonly known as a bypass ratio. The pressure of the second portion of air 64 is then increased, forming compressed air 65, and the compressed air 65 is routed through the HP compressor 24 and into the combustion section 26, where the compressed air 65 is mixed with fuel and burned to provide combustion gases 66.

The combustion gases 66 are routed into the HP turbine 28 and expanded through the HP turbine 28 where a portion of thermal energy and/or kinetic energy from the combustion gases 66 is extracted via sequential stages of HP turbine stator vanes 68 that are coupled to the outer casing 18 and HP turbine rotor blades 70 that are coupled to the HP shaft 34, thus, causing the HP shaft 34 to rotate, thereby supporting operation of the HP compressor 24. The combustion gases 66 are then routed into the LP turbine 30 and expanded through the LP turbine 30. Here, a second portion of thermal energy and/or the kinetic energy is extracted from the combustion gases 66 via sequential stages of LP turbine stator vanes 72 that are coupled to the outer casing 18 and LP turbine rotor blades 74 that are coupled to the LP shaft 36, thus, causing the LP shaft 36 to rotate, thereby supporting operation of the LP compressor 22 and rotation of the fan 38 via the gearbox assembly 46.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before being exhausted from a fan nozzle exhaust section 76 of the turbine engine 10, also providing propulsive thrust. The HP turbine 28, the LP turbine 30, and the jet exhaust nozzle section 32 at least partially define a hot gas path 78 for routing the combustion gases 66 through the core turbine engine 16.

As detailed above, the second portion of air 64 is mixed with fuel 67 in the combustion section 26 to produce the combustion gases 66. The turbine engine 10 also includes a fuel system 80 for providing the fuel 67 to the combustion section 26. The fuel system 80 includes a fuel tank (not shown) for storing fuel therein and one or more fuel injector lines 82 to provide the fuel 67 to the combustion section 26, as detailed further below.

The turbine engine 10 depicted in FIG. 1 is by way of example only. In other exemplary embodiments, the turbine engine 10 may have any other suitable configuration. For example, in other exemplary embodiments, the fan 38 may be configured in any other suitable manner (e.g., as a fixed pitch fan) and further may be supported using any other suitable fan frame configuration. Moreover, in other exemplary embodiments, any other suitable number or configuration of compressors, turbines, shafts, or a combination thereof may be provided. In still other exemplary embodiments, aspects of the present disclosure may be incorporated into any other suitable turbine engine, such as, for example, turbofan engines, propfan engines, turbojet engines, turboprop, and/or turboshaft engines.

Figure 2:
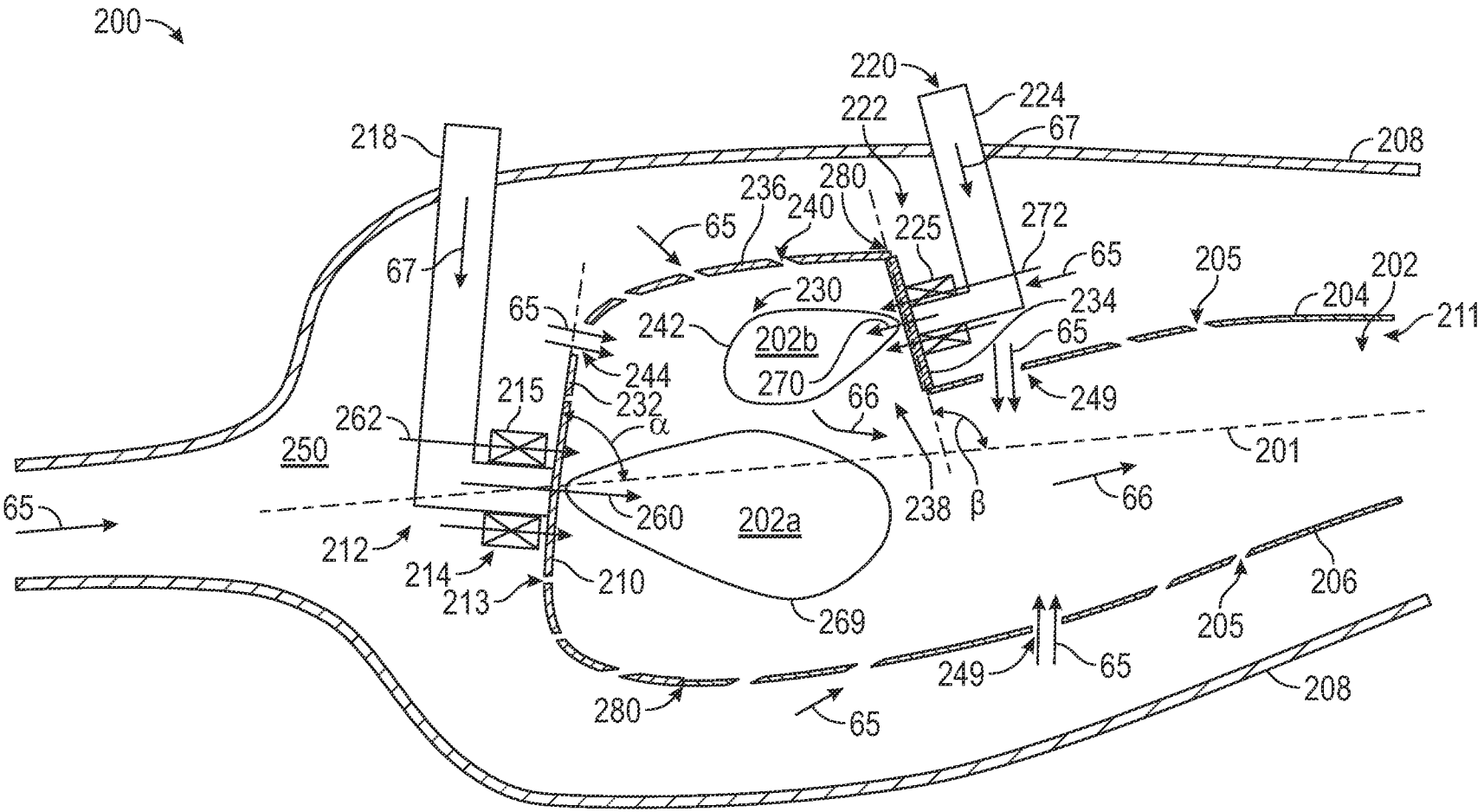
FIG. 2 is a schematic cross-sectional diagram of a combustor for the turbine engine of FIG. 1, taken along a longitudinal centerline axis of the turbine engine, according to the present disclosure.

FIG. 2 is a schematic cross-sectional diagram of a combustor 200 for the turbine engine 10 (FIG. 1), taken along a longitudinal centerline axis 12 (FIG. 1) of the turbine engine 10, according to the present disclosure. In the exemplary embodiment, the combustion section 26 (FIG. 1) includes the combustor 200 having a main combustion chamber 202 defined by an outer liner 204 and an inner liner 206. The main combustion chamber 202 includes a longitudinal centerline axis 201 and the outer liner 204 and the inner liner 206 are annular about the longitudinal centerline axis 201 of the longitudinal centerline axis 201. The outer liner 204 defines a radially outer boundary of the main combustion chamber 202, and the inner liner 206 defines a radially inner boundary of the main combustion chamber 202. The outer liner 204 and/or the inner liner 206 include one or more liner air holes 205 that operably direct the compressed air 65 through the outer liner 204 and/or through the inner liner 206 and into the main combustion chamber 202 to cool the outer liner 204 and/or the inner liner 206 (e.g., by film cooling). The outer liner 204 and the inner liner 206 are spaced radially inward from an annular combustor casing 208 that extends circumferentially about the outer liner 204 and the inner liner 206.

The combustor 200 also includes an annular dome 210 mounted upstream from the outer liner 204 and the inner liner 206. The annular dome 210 defines an upstream end of the main combustion chamber 202. The main combustion chamber 202 extends from the annular dome 210 downstream to a combustion chamber outlet 211. The annular dome 210 includes one or more annular dome air holes 213 that operably direct the compressed air 65 through the annular dome 210 for cooling a downstream surface of the annular dome 210 within the main combustion chamber 202 (e.g., by film cooling).

A plurality of first mixing assemblies 212 (only one is illustrated in FIG. 2) are spaced circumferentially about the annular dome 210 to deliver a first mixture of fuel and air to the main combustion chamber 202. For example, the plurality of first mixing assemblies 212 delivers the first mixture of fuel and air into a first recirculation zone 202*a* of the main combustion chamber 202, as detailed further below. Each first mixing assembly 212 includes a pilot mixer 214 that includes a first mixing assembly air swirler 215 that swirls the compressed air 65 through the pilot mixer 214 and into the main combustion chamber 202, as detailed further below. A plurality of first fuel injectors 218 (only one is illustrated in FIG. 2) are coupled in flow communication with each respective first mixing assembly 212. The plurality of first fuel injectors 218 are spaced circumferentially about the annular dome 210 and extend axially from the annular combustor casing 208 to the plurality of first mixing assemblies 212.

A plurality of second mixing assemblies 220 (only one illustrated in FIG. 2) are spaced circumferentially about the outer liner 204 to deliver a second mixture of fuel and air to a secondary combustion chamber 230, detailed further below. For example, the plurality of second mixing assemblies 220 delivers the second mixture of fuel and air into a second recirculation zone 202*b* of the secondary combustion chamber 230, as detailed further below. The second recirculation zone 202*b* is located at least partially axially aft of the first recirculation zone 202*a*. In this way, the second recirculation zone 202*b* is located at least partially downstream of the first recirculation zone 202*a*. Each of the plurality of second mixing assemblies 220 includes a main mixer 222. The main mixer 222 includes a second mixing assembly air swirler 225 that swirls the compressed air 65 in the second recirculation zone 202*b*, as detailed further below. A plurality of second fuel injectors 224 (only one is illustrated in FIG. 2) are coupled in flow communication with each respective second mixing assembly 220. The plurality of second fuel injectors 224 are spaced circumferentially about the outer liner 204 and extend axially from the annular combustor casing 208 to the plurality of second mixing assemblies 220.

The secondary combustion chamber 230 is formed in the outer liner 204 and defines the second recirculation zone 202*b*. While one secondary combustion chamber 230 is shown and described in FIG. 2, the combustor 200 can include one or more secondary combustion chambers 230. The secondary combustion chamber 230 is a cavity and is utilized to produce the second recirculation zone 202*b* of a fuel-air mixture, as detailed further below. While FIG. 2 shows the secondary combustion chamber 230 formed in the outer liner 204, the secondary combustion chamber 230 can be formed in the inner liner 206. In some embodiments, both the outer liner 204 and the inner liner 206 include a secondary combustion chamber 230 formed therein.

The secondary combustion chamber 230 is defined by a portion of the annular dome 210. For example, the annular dome 210 is a wrapped annular dome such that a portion of the annular dome 210 extends axially aft, or axially downstream, from the annular dome 210. The secondary combustion chamber 230 includes a forward wall 232, an aft wall 234, an axial wall 236 that extends axially from the forward wall 232 to the aft wall 234, and a secondary combustion chamber opening 238. The forward wall 232 and the axial wall 236 are defined by the annular dome 210 such that the annular dome 210 forms a portion of the secondary combustion chamber 230, and the forward wall 232 and the axial wall 236 form a single, unitary component. The aft wall 234 extends radially outward from the outer liner 204, the axial wall 236 extends axially from the forward wall 232 to the aft wall 234, and the secondary combustion chamber 230 is defined between the forward wall 232, the aft wall 234, and the axial wall 236. In this way, the secondary combustion chamber 230 is located radially outward from the main combustion chamber 202. The secondary combustion chamber opening 238 is an opening in the outer liner 204 to provide flow communication from the secondary combustion chamber 230 to the main combustion chamber 202. While the secondary combustion chamber 230 illustrated in FIG. 2 includes a substantially rectangular cross section, the secondary combustion chamber 230 can include any shape.

The annular dome 210 is coupled to the inner liner 206 and to the aft wall 234 by one or more annular dome joints 280. The one or more annular dome joints 280 can include any type of joint or coupling mechanism, such as, for example, welding, bolts, or the like.

The secondary combustion chamber 230 includes one or more secondary combustion chamber air holes 240 in the forward wall 232, in the aft wall 234, and/or in the axial wall 236. The one or more secondary combustion chamber air holes 240 operably direct the compressed air 65 through the forward wall 232, the aft wall 234, and/or the axial wall 236 into the secondary combustion chamber 230 to cool the forward wall 232, the aft wall 234, and/or the axial wall 236. A size of each of the one or more secondary combustion chamber air holes 240, the number of the one or more secondary combustion chamber air holes 240, and/or the circumferential spacing between respective ones of the one or more secondary combustion chamber air holes 240, may be based on a desired amount of cooling air (e.g., the compressed air 65) desired to cool the forward wall 232, the aft wall 234, and/or the axial wall 236. In addition, while FIG. 2 depicts the one or more secondary combustion chamber air holes 240 as being generally circular openings, other shapes may be implemented for the openings instead. For example, the one or more secondary combustion chamber air holes 240 may be oval-shaped slots, or the like.

The secondary combustion chamber 230 also includes one or more combustion air holes 244 disposed through the forward wall 232 (e.g., through the annular dome 210). The one or more combustion air holes 244 are sized to operably direct the compressed air 65 into the secondary combustion chamber 230 for providing additional air in the combustion process within the secondary combustion chamber 230. In this way, the one or more combustion air holes 244 are larger than the one or more secondary combustion chamber air holes 240. The one or more combustion air holes 244 operably direct the compressed air 65 axially aftward through the forward wall 232 and into the secondary combustion chamber 230.

The combustor 200 includes one or more liner combustion air holes 249 extending through the outer liner 204 and/or through the inner liner 206. The one or more liner combustion air holes 249 operably direct the compressed air 65 through the outer liner 204 and/or the inner liner 206 into the main combustion chamber 202 to provide additional air for combustion. In this way, the compressed air 65 is referred to as dilution air or combustion air, and assists in profile trimming (e.g., adjusting the exit temperature distribution or the radial temperature profile by modifying the amount of dilution air, for example, by changing the number of dilution holes between the inner liner and the outer liner, or by changing the diameter of the dilution holes).

The forward wall 232 (e.g., the annular dome 210) is positioned at a first angle α with respect to the longitudinal centerline axis 201 of the main combustion chamber 202. The first angle α is greater than 90° and less than 180° or less than 90° and greater than 0°. The plurality of first mixing assemblies 212 are disposed through the annular dome 210 such that the pilot mixer 214 injects the fuel 67 and the compressed air 65 into the main combustion chamber 202 to generate the first recirculation zone 202*a*. For example, the plurality of first mixing assemblies 212 are disposed through the annular dome 210 such that the pilot mixer 214 injects the fuel 67 and the compressed air 65 perpendicular with respect to the annular dome 210 and at a pilot mixer fuel-air mixture angle such that the first recirculation zone 202*a* is at the pilot mixer fuel-air mixture angle with respect to the longitudinal centerline axis 201. The pilot mixer fuel-air mixture angle of the first recirculation zone 202*a*, for example, is a complimentary angle to the first angle α. In this way, the first recirculation zone 202*a* (e.g., the fuel 67 and the compressed air 65 that is injected into the main combustion chamber 202) includes both an axial vector and a radial vector. Angling the plurality of first mixing assemblies 212 in such a way helps to improve mixing of the fuel 67 and the compressed air 67, as compared to combustors without the benefit of the present disclosure. In FIG. 2, the first angle α is less than 90° and greater than 0° such that the majority (e.g., greater than 50%) of the first recirculation zone 202*a* is radially inward of the longitudinal centerline axis 201 (e.g., below the longitudinal centerline axis 201 in the orientation of FIG. 2).

The aft wall 234 of the secondary combustion chamber 230 is positioned at a second angle β with respect to the longitudinal centerline axis 201 of the main combustion chamber 202. The second angle β is greater than 90° and less than 180° or less than 90° and greater than 0°. The plurality of second mixing assemblies 220 are disposed through the aft wall 234 such that the main mixer 222 injects the fuel 67 and the compressed air 65 into the secondary combustion chamber 230 to generate the second recirculation zone 202*b*. For example, the plurality of second mixing assemblies 220 are disposed through the aft wall 234 of the secondary combustion chamber 230 such that the main mixer 222 injects the fuel 67 and the compressed air 65 perpendicular with respect to the aft wall 234 and at a main mixer fuel-air mixture angle such that the second recirculation zone 202*b* is at the main mixer fuel-air mixture angle with respect to the longitudinal centerline axis 201. The main mixer fuel-air mixture angle of the second recirculation zone 202*b*, for example, is a complimentary angle to the second angle β. In this way, the second recirculation zone 202*b* (e.g., the fuel 67 and the compressed air 65 that is injected into the secondary combustion chamber 230) includes both an axial vector and a radial vector. In this way, angling the plurality of second mixing assemblies 220 in such a way helps to improve mixing of the fuel 67 and the compressed air 65. In FIG. 2, the second angle β is greater than 90° and less than 180°. The main mixer 222 injects the fuel 67 and the compressed air 65 into the secondary combustion chamber 230 such that an entirety (e.g., 100%) of the second recirculation zone 202*b* is radially outward of the longitudinal centerline axis 201 (e.g., above the longitudinal centerline axis 201 in the orientation of FIG. 2).

In operation, the combustor 200 receives compressed air 65 discharged from the HP compressor 24 (FIG. 1) in a diffuser section 250 at a location upstream of the main combustion chamber 202. A portion of the compressed air 65 is channeled through the first mixing assembly 212. At the first mixing assembly 212, the compressed air 65 is mixed with the fuel 67 from the first fuel injector 218 and discharged axially forward into the main combustion chamber 202 to generate a main combustion chamber swirl air flow 269 within the first recirculation zone 202*a*. The first mixing assembly air swirler 215 swirls the compressed air 65 therethrough in a first swirl direction. The first mixture of compressed air 65 and fuel 67 is ignited by an igniter (not shown in FIG. 2 for clarity) creating a first flame within the main combustion chamber 202 that burns the first mixture and provides combustion gases 66 that are channeled downstream to a first stage turbine nozzle of the HP turbine 28 (FIG. 1). For example, the first flame burns within the first recirculation zone 202*a*.

At the second mixing assembly 220, the compressed air 65 is mixed with the fuel 67 from the second fuel injector 224 and discharged axially aftward into the secondary combustion chamber 230 to generate a secondary combustion chamber swirl air flow 242 within the second recirculation zone 202*b*. The second mixing assembly air swirler 225 swirls the compressed air 65 therethrough in a second swirl direction. The second swirl direction is the same as the first swirl direction such that the first swirl direction and the second swirl direction are co-rotating. In some embodiments, the second swirl direction is different from the first swirl direction such that the first swirl direction and the second swirl direction are counter-rotating. In the secondary combustion chamber 230, the compressed air 65 (e.g., the secondary combustion chamber swirl air flow 242) is mixed with the fuel 67 from the second fuel injector 224 to produce a second mixture of the compressed air 65 and the fuel 67. The second mixture of the compressed air 65 and the fuel 67 is ignited by an igniter (not shown in FIG. 2 for clarity) creating a second flame within the secondary combustion chamber 230 that burns the second mixture and generates combustion gases 66. The secondary combustion chamber 230 injects the combustion gases 66 through the secondary combustion chamber opening 238 into the main combustion chamber 202. The combustion gases 66 from the first recirculation zone 202*a* mix with the combustion gases 66 from the secondary combustion chamber 230 and then exit the main combustion chamber 202 through the combustion chamber outlet 211, and are channeled downstream to the first stage turbine nozzle of the HP turbine 28 (FIG. 1).

A portion of the compressed air 65 is also injected through the one or more secondary combustion chamber air holes 240 into the secondary combustion chamber 230 to cool the forward wall 232, the aft wall 234, and/or the axial wall 236 (e.g., by film cooling). The one or more combustion air holes 244 operably direct the compressed air 65 into the secondary combustion chamber 230. A portion of the compressed air 65 is also injected through the one or more combustion air holes 244 into the secondary combustion chamber 230 to provide additional air for the combustion process within the secondary combustion chamber 230.

The combustor 200 is a multi-staged combustor. In particular, the plurality of first mixing assemblies 212 provides for fuel staging at the annular dome 310 in the first recirculation zone 202*a*, and the plurality of second mixing assemblies 220 provides for axial fuel staging in the second recirculation zone 202*b*. For example, a portion of the secondary combustion chamber 230, the plurality of second mixing assemblies 220, and the second recirculation zone 202*b* are located axially downstream of the plurality of first mixing assemblies 212 and a portion the first recirculation zone 202*a*, respectively. For example, the second recirculation zone 202*b* is axially downstream of a forward portion of the first recirculation zone 202*a*. Such a configuration of the combustor 200 provides for rich combustion in the first recirculation zone 202*a* (e.g., in an area of the annular dome 210) provided by the plurality of first mixing assemblies 212 (e.g., by the pilot mixer 214), and lean combustion provided by the plurality of second mixing assemblies 220 to further reduce NOx emissions as compared to combustors without the benefit of the present disclosure, as detailed further below. For example, such a configuration of the fuel injection direction of the plurality of second mixing assemblies 220 being in an opposite direction of the fuel injection of the plurality of first mixing assemblies 212 provides for improved mixing, improved residence time, as well as axial staging and radial staging, for reducing NOx emissions at high fuel-air ratios encountered in advanced thermodynamic cycles, as compared to combustors without the benefit of the present disclosure.

The combustor 200 is a rich dome combustor defined by rich combustion in the first recirculation zone 202*a* in an area of the annular dome 210 within the main combustion chamber 202. Specifically, at engine start conditions and at engine low power operation (e.g., less than 30% of a sea level static (SLS) maximum engine rated thrust) of the turbine engine 10 (FIG. 1), such as at idle, at taxi, or at approach, the combustor 200 uses only the fuel 67 provided to the pilot mixer 214 for generating the combustion gases 66. At the pilot mixer 214, the fuel 67 includes a pilot fuel stream 260 that is mixed with a first portion 262 of the compressed air 65 to provide a rich fuel-air mixture (e.g., higher fuel-to-air ratios within the mixture) that is ignited for a pilot flame within the first recirculation zone 202*a* that is adjacent to the pilot mixer 214 and within an area of the annular dome 210. The fuel-air mixture from the pilot mixer 214 is referred to as a pilot mixer fuel-air mixture. The pilot mixer 214 injects the pilot fuel stream 260 at the pilot mixer fuel-air mixture angle with respect to the longitudinal centerline axis 201 from the first mixing assembly 212, as detailed above. The pilot mixer 214 swirls the first portion 262 of the compressed air 65 in a first swirl direction to generate the main combustion chamber swirl air flow 269 in the main combustion chamber 202, as detailed above. The fuel-air mixture from the pilot mixer 214 is referred to as a pilot mixer fuel-air mixture.

In some embodiments, the combustor 200 can use the fuel 67 split between the pilot mixer 214 and the main mixer 222 during the engine low power operation. For example, at the secondary combustion chamber 230, the fuel 67 includes a main fuel stream 270 (e.g., injected from the second fuel injector 224) that is mixed with a second portion 272 of the compressed air 65 (e.g., injected through the second mixing assembly air swirler 225) to provide a lean fuel-air mixture (e.g., lower fuel-to-air ratios within the mixture) that is ignited for a main flame within the secondary combustion chamber 230 that is adjacent the main mixer 222, thus, providing a lean burn combustion process to generate combustion gases 66 while further reducing NOx emissions by operating fuel-lean. Further, the lean burn combustion process provides for low non-volatile particulate matter (nvPM), such as soot or smoke, and reduces NOx emissions. The fuel-air mixture from the main mixer 222 is referred to as a main mixer fuel-air mixture.

The main mixer 222 injects the main fuel stream 270 axially forward into the secondary combustion chamber 230 that is axially downstream of the pilot mixer fuel-air mixture. The combustion gases 66 produced in the secondary combustion chamber 230 are then injected into the main combustion chamber 202 through the secondary combustion chamber opening 238 axially aft, or axially downstream, of the first recirculation zone 202*a*, as detailed above. In this way, the combustor 200 provides for axial staging (e.g., at the second mixing assembly 220) within the secondary combustion chamber 230 to provide for a greater reduction in NOx emissions compared to combustors without the benefit of the present disclosure. For example, the air splits and the fuel splits to the plurality of first mixing assemblies 212 and to the plurality of second mixing assemblies 220 can be controlled at different operating conditions of the combustor 200 to reduce the NOx emissions throughout the entire operating cycle of the combustor 200, as detailed further below.

At high power operation (e.g., greater than 85% of SLS maximum engine rated thrust) of the turbine engine 10 (FIG. 1), such as at takeoff or at climb, and at mid-level power operation (e.g., 30% to 85% of SLS maximum engine rated thrust) of the turbine engine 10 (FIG. 1), such as at cruise, the combustor 200 splits the fuel 67 between the pilot mixer 214 and the main mixer 222 for generating the combustion gases 66 in the first recirculation zone 202*a* of the main combustion chamber 202 and in the second recirculation zone 202*b* of the secondary combustion chamber 230, respectively. In this way, the combustor 200 permits control of the combustion dynamics in an axially staged combustion configuration in which the axially staging is provided by the secondary combustion chamber 230 located axially aft, or downstream, of a portion of the first recirculation zone 202*a* (e.g., a forward portion of the first recirculation zone 202*a*). The fuel split between the pilot mixer 214 and the main mixer 222 can be optimized to mitigate dynamics while also meeting combustor performance metrics for the various operating cycles of the turbine engine 10 (FIG. 1). For example, the fuel split between the pilot mixer 214 and the main mixer 222 is controlled to reduce NOx emissions during the entire operating cycle (e.g., idle, taxi, takeoff, climb, cruise, and approach). Such a configuration of the combustor 200 with axial staging and radial staging allows for a shorter residence time of the second flame, thereby, reducing NOx emissions as compared to combustors without the benefit of the present disclosure. Such a configuration stabilizes the second flame at lean fuel-air ratios easier as compared to combustors without the benefit of the present disclosure.

During operation, the compressed air 65 is split among the annular dome 210, the pilot mixer 214, the main mixer 222 (e.g., the secondary combustion chamber 230), between the outer liner 204 and the annular combustor casing 208, and between the inner liner 206 and the annular combustor casing 208. The compressed air 65 is split to provide a rich burn in the first recirculation zone 202*a* and a lean burn in the secondary combustion chamber 230, as detailed further below. Such a configuration is referred to as a first rich dome embodiment. For example, the combustor 200, the annular dome 210, the plurality of first mixing assemblies 212, and the plurality of second mixing assemblies 220 are oriented and configured to provide 5% to 9% of the compressed air 65 to the annular dome 210, 12% to 20% of the compressed air 65 to the pilot mixer 214 (e.g., the first portion 262 of compressed air 65), 15% to 30% of the compressed air 65 to the main mixer 222 (e.g., the second portion 272 of compressed air 65), 35% to 50% of the compressed air 65 to dilution holes (e.g., the secondary combustion chamber air holes 240), 7% to 10% of the compressed air 65 to the outer liner 204 and the inner liner 206 in an area forward of the plurality of second mixing assemblies 220, and 6% to 9% of the compressed air 65 to the outer liner 204 and the inner liner 206 in an area aft of the plurality of second mixing assemblies 220. In summary, the pilot fuel stream 260 includes 95% to 100% of the fuel 67 during idle conditions of the turbine engine, 95% to 100% of the fuel during approach conditions of the turbine engine, 95% to 100% of the fuel during cruise conditions of the turbine engine, and 65% to 80% of the fuel during climb conditions or take-off conditions of the turbine engine. The main fuel stream 270 includes 0% to 5% of the fuel during idle conditions of the turbine engine, 0% to 5% of the fuel during approach conditions of the turbine engine, 0% to 5% of the fuel during cruise conditions of the turbine engine, and 20% to 35% of the fuel during climb conditions or take-off conditions of the turbine engine. The fuel splits are selected to be fuel-rich for good operability at low power operation (e.g., idle, taxi, approach, etc.) and to be fuel-lean at mid-power operation (e.g., cruise) and high power operation (e.g., take-off or climb) for low NOx emissions.

The fuel-air mixture for each of the pilot mixer 214 and the main mixer 222 is defined by an equivalence ratio. The equivalence ratio is an actual fuel-air ratio (e.g., the fuel-air splits detailed above) to a stoichiometric fuel-air ratio. The actual fuel-air ratio is the fuel-air ratio provided to each of the pilot mixer 214 and the main mixer 222. The stoichiometric fuel-air ratio is an ideal fuel-air ratio that burns all fuel with no excess air. If the equivalence ratio is less than one, the combustion is considered lean with excess air, and if the equivalence ratio is greater than one, the combustion is considered rich with incomplete combustion.

In general, for the pilot mixer 214, the pilot mixer equivalence ratio increases from idle, to approach, to cruise, to climb, and to take-off. For example, the pilot mixer 214 generates a rich burn (e.g., the pilot mixer equivalence ratio is greater than one) for the operating cycle of the turbine engine (e.g., the turbine engine 10 of FIG. 1). Such a configuration allows for reduced airflow to the pilot mixer 214 to improve light off or blow out or to reduce smoke, as compared to combustors without the benefit of the present disclosure. Such a configuration also allows for increasing the airflow to the main mixer 222 to reduce NOx emissions. In general, for the main mixer 222, the main mixer equivalence ratio increases from idle, to approach, to cruise, to climb, and to take-off. For example, the main mixer 222 generates a lean burn (e.g., the main mixer equivalence ratio is less than one) for the entire operating cycle of the turbine engine (e.g., the turbine engine 10 of FIG. 1).

In a second rich dome embodiment, the compressed air 65 and the fuel 67 are split between the pilot mixer 214 and the main mixer 222 to provide rich burn combustion in the first recirculation zone 202*a* of the main combustion chamber 202 and lean burn combustion in the second recirculation zone 202*b* of the secondary combustion chamber 230 to reduce NOx emissions. For example, in the second rich dome embodiment, the annular dome 210, the plurality of first mixing assemblies 212 and the plurality of second mixing assemblies 220 are oriented and configured to provide 5% to 9% of the compressed air 65 to the annular dome 210, 12% to 20% of the compressed air 65 to the pilot mixer 214 (e.g., the first portion 262 of compressed air 65), 45% to 65% of the compressed air 65 to the main mixer 222 (e.g., the second portion 272 of compressed air 65), 5% to 15% of the compressed air 65 to the one or more combustion air holes 244, 7% to 9% of the compressed air 65 to the outer liner 204 and the inner liner 206 in an area forward of the plurality of second mixing assemblies 220, and 7% to 9% of the compressed air 65 to the outer liner 204 and the inner liner 206 in an area aft of the plurality of second mixing assemblies 220.

In the second rich dome embodiment, the pilot fuel stream 260 includes 80% to 100% of the fuel 67 during idle conditions of the turbine engine, 40% to 100% of the fuel during approach conditions of the turbine engine, 15% to 50% of the fuel during cruise conditions of the turbine engine, and 15% to 50% of the fuel during climb conditions or take-off conditions of the turbine engine. The main fuel stream 270 includes 0% to 20% of the fuel during idle conditions of the turbine engine, 0% to 60% of the fuel during approach conditions of the turbine engine, 50% to 85% of the fuel during cruise conditions of the turbine engine, and 50% to 85% of the fuel during climb conditions or take-off conditions of the turbine engine.

In general, for the pilot mixer 214, the pilot mixer equivalence ratio decreases from idle, to approach, to cruise, and increases from cruise to climb, and to take-off. For example, the pilot mixer 214 generates a rich burn (e.g., the pilot mixer equivalence ratio is greater than one) for the operating cycle of the turbine engine (e.g., the turbine engine 10 of FIG. 1). In some instances, the pilot mixer 214 can operate fuel-lean (e.g., the pilot mixer equivalence ratio is less than one), for example, during a mid-power operation (e.g., cruise) or a high-power operation (e.g., take-off or climb). In general, for the main mixer 222, the main mixer equivalence ratio increases from idle, to approach, to cruise, to climb, and to take-off. For example, the main mixer 222 generates a lean burn (e.g., the main mixer equivalence ratio is less than one) for the entire operating cycle of the turbine engine (e.g., the turbine engine 10 of FIG. 1).

Figure 3:
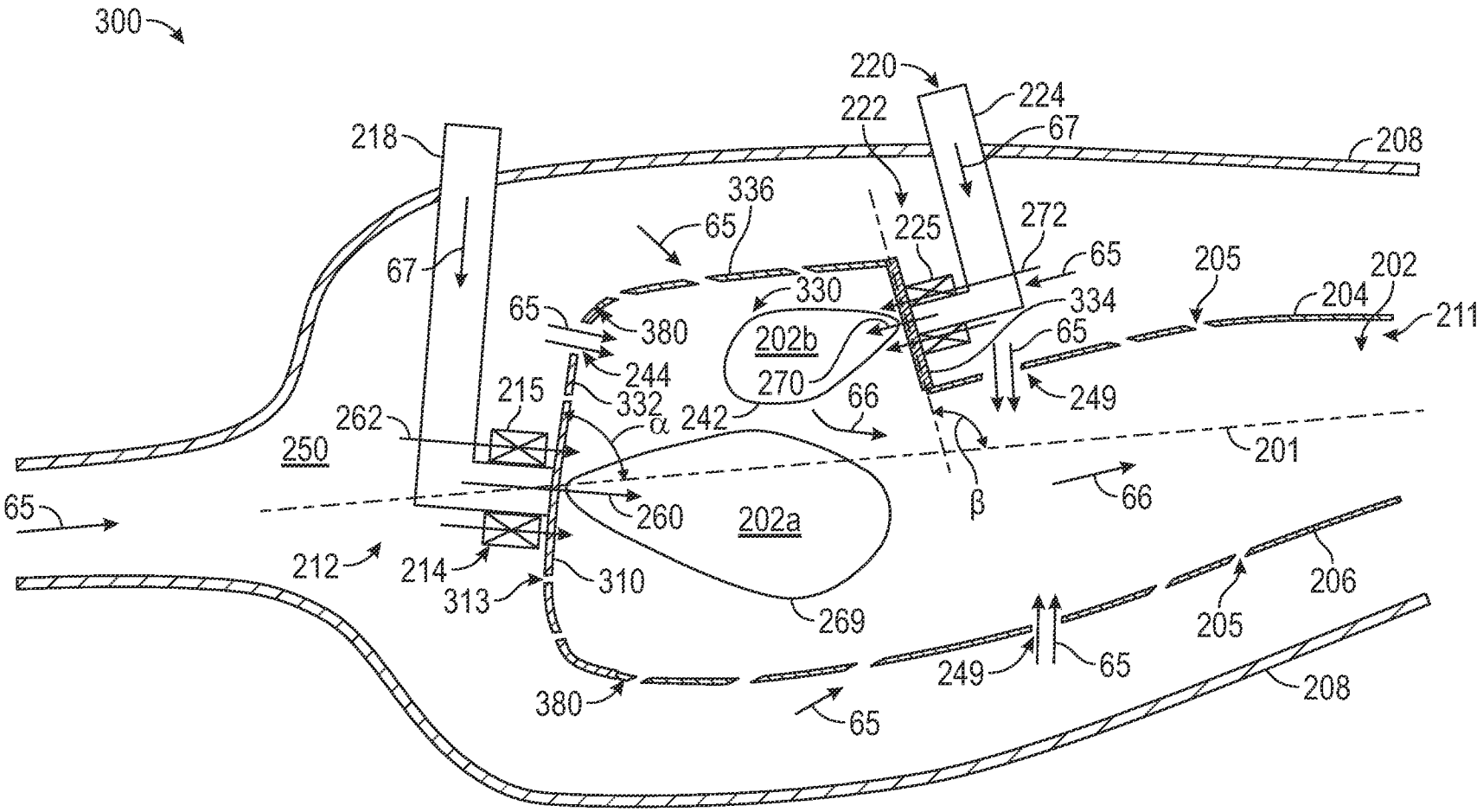
FIG. 3 is a schematic cross-sectional diagram of a combustor for a turbine engine, taken along a longitudinal centerline axis of the turbine engine, according to another embodiment.

FIG. 3 is a schematic cross-sectional diagram of a combustor 300 for a turbine engine, taken along a longitudinal centerline axis of the turbine engine, according to another embodiment. The combustor 300 is substantially similar to the combustor 200 of FIG. 2. The combustor 300, however, includes an annular dome 310 and a secondary combustion chamber 330 that are different from the annular dome 210 and the secondary combustion chamber 230 of FIG. 2. The annular dome 310 includes one or more annular dome air holes 313 that operably direct the compressed air 65 through the annular dome 310 for cooling a downstream surface of the annular dome 310 within the main combustion chamber 202 (e.g., by film cooling).

The secondary combustion chamber 330 includes a forward wall 332 that is defined by the annular dome 310, an aft wall 334, and an axial wall 336 that extends generally axially from the forward wall 332 to the aft wall 334. The aft wall 334 and the axial wall 336 are defined by the outer liner 204 (e.g., or by the inner liner 206). In this way, the annular dome 310 is a bulkhead dome such that the annular dome 310 does not include a portion that extends axially aftward. The annular dome 310 is coupled to the inner liner 206 and to the axial wall 336 by one or more annular dome joints 380. The one or more annular dome joints 380 can include any type of joint or coupling mechanism, such as, for example, welding, bolts, or the like. The combustor 300 functions substantially similarly to the combustor 200 of FIG. 2.

Figure 4:
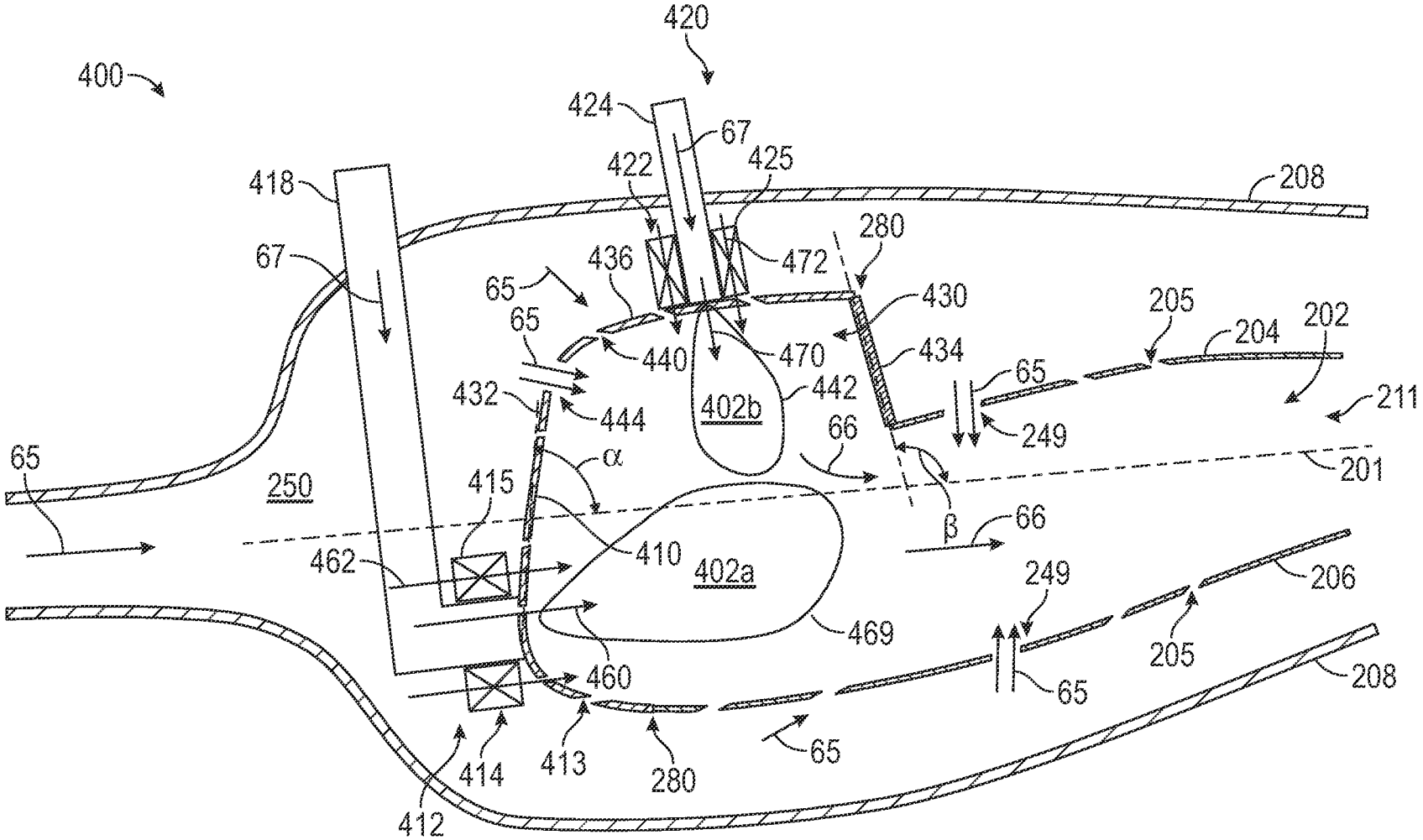
FIG. 4 is a schematic cross-sectional diagram of a combustor for a turbine engine, taken along a longitudinal centerline axis of the turbine engine, according to another embodiment.

FIG. 4 is a schematic cross-sectional diagram of a combustor 400 for a turbine engine, taken along a longitudinal centerline axis of the turbine engine, according to another embodiment. The combustor 400 is substantially similar to the combustor 200 of FIG. 2. The combustor 400, however, includes an annular dome 410 and a secondary combustion chamber 430 that are different from the annular dome 210 and the secondary combustion chamber 230 of FIG. 2.

The combustor 400 includes a plurality of first mixing assemblies 412 including a pilot mixer 414 and a first fuel injector 418, and a plurality of second mixing assemblies 420 including a main mixer 422 and a second fuel injector 424. The secondary combustion chamber 430 includes a forward wall 432, an aft wall 434, and an axial wall 436 that extends generally axially from the forward wall 432 to the axial wall 436. One or more secondary combustion chamber air holes 440 are disposed through the forward wall 432, the aft wall 434, and/or the axial wall 436. Similar to the combustor 200 of FIG. 2, the annular dome 410 is a wrapped annular dome such that the forward wall 432 and the axial wall 436 are defined by the annular dome 410. The annular dome 410 also includes one or more annular dome air holes 413. The secondary combustion chamber 430 also includes one or more combustion air holes 444 disposed through the forward wall 432 (e.g., through the annular dome 410).

In this way, the annular dome 410 and the secondary combustion chamber 430 are similar to the annular dome 210 and the secondary combustion chamber 230 of FIG. 2. The positions and locations of the plurality of first mixing assemblies 412 and the plurality of second mixing assemblies 420, however, are different from the positions and locations of the plurality of first mixing assemblies 212 and the plurality of second mixing assemblies 220 of FIG. 2.

The pilot mixer 414 is positioned through the annular dome 410 entirely radially within the longitudinal centerline axis 201 and is angled with respect to the longitudinal centerline axis 201 (e.g., angled towards the longitudinal centerline axis 201). In this way, the pilot mixer 414 injects a pilot fuel stream 460 and a first portion 462 of the compressed air 65 at a pilot mixer fuel-air mixture angle with respect to the longitudinal centerline axis 201. The pilot mixer fuel-air mixture angle is less than 90° such that the pilot mixer 414 injects the pilot fuel stream 460 and the first portion 462 of the compressed air 65 axially aftward and radially outward towards the longitudinal centerline axis 201. The pilot mixer 414 includes a pilot mixer air swirler 415 that swirls the first portion 462 of the compressed air 65 to generate a main combustion chamber swirl air flow 469 within the first recirculation zone 402*a* in the main combustion chamber 202. A majority (e.g., greater than 50%) of the first recirculation zone 402*a* is radially inward of the longitudinal centerline axis 201.

The main mixer 422 is positioned through the axial wall 436 (e.g., the annular dome 410) of the secondary combustion chamber 430 and is angled with respect to the longitudinal centerline axis 201. For example, the axial wall 436 is angled from the forward wall 432 to the aft wall 434. In this way, the main mixer 422 injects a main fuel stream 470 and a second portion 472 of the compressed air 65 at a main mixer fuel-air mixture angle (e.g., the main mixer fuel-air mixture angle in FIG. 4 is equal to the second angle β) with respect to the longitudinal centerline axis 201. The main mixer fuel-air mixture angle is greater than 90° and less than 180° such that the main mixer 422 injects the main fuel stream 470 and the second portion 472 of the compressed air 65 radially inwards and axially aftward towards the longitudinal centerline axis 201. The main mixer 422 includes a second mixing assembly air swirler 425 that swirls the second portion 472 of the compressed air 65 to generate a secondary combustion chamber swirl air flow 442 within the second recirculation zone 402*b* in the secondary combustion chamber 230. An entirety (e.g., 100%) of the second recirculation zone 402*b* is radially outward of the longitudinal centerline axis 201. The main mixer 422 is positioned axially aft, or axially downstream, of the pilot mixer 414.

Figure 5:
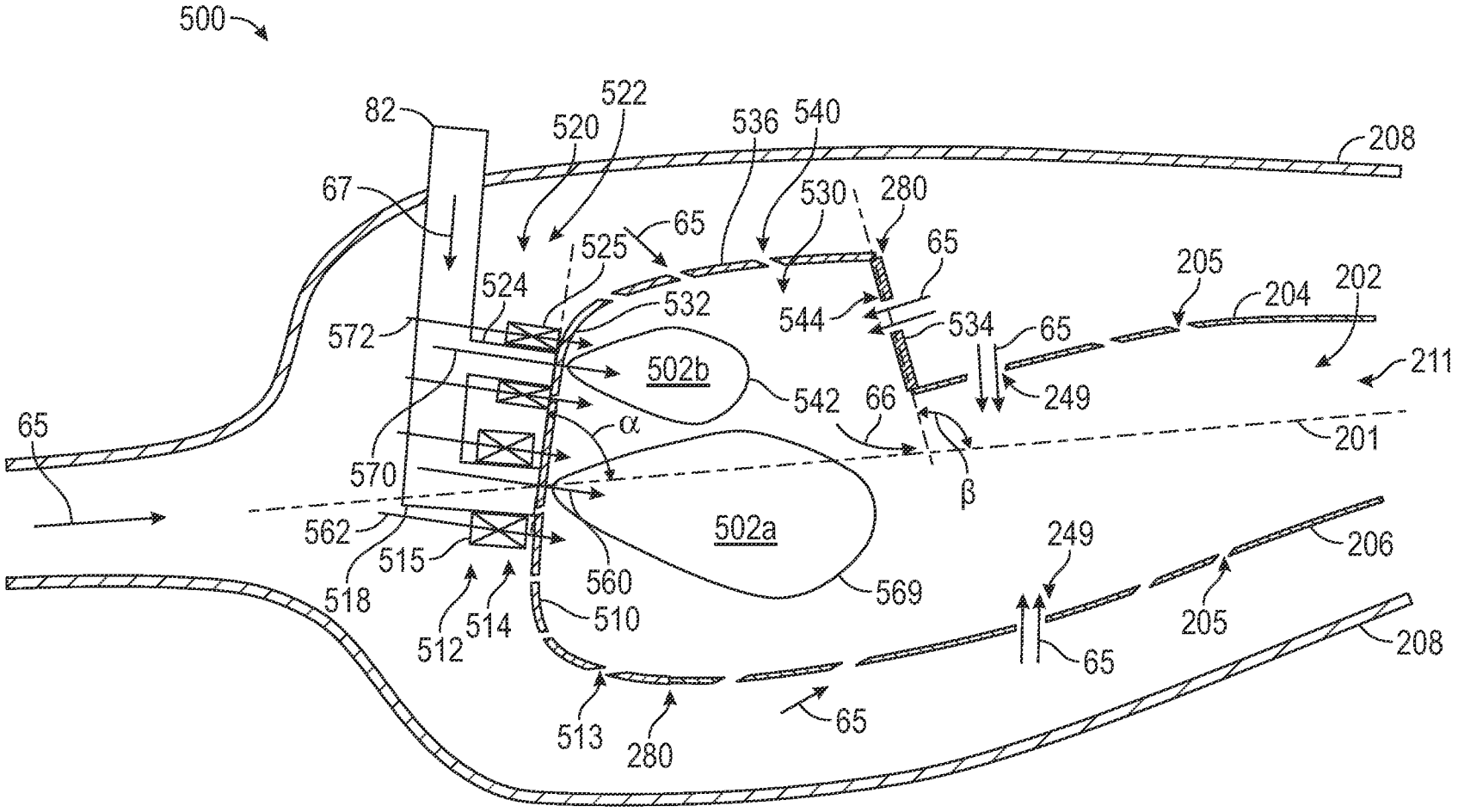
FIG. 5 is a schematic cross-sectional diagram of a combustor for a turbine engine, taken along a longitudinal centerline axis of the turbine engine, according to another embodiment.

FIG. 5 is a schematic cross-sectional diagram of a combustor 500 for a turbine engine, taken along a longitudinal centerline axis of the turbine engine, according to another embodiment. The combustor 500 is substantially similar to the combustor 200 of FIG. 2. The combustor 500, however, includes an annular dome 510 and a secondary combustion chamber 530 that are different from the annular dome 210 and the secondary combustion chamber 230 of FIG. 2.

The combustor 500 includes a plurality of first mixing assemblies 512 including a pilot mixer 514 and a first fuel injector 518, and a plurality of second mixing assemblies 520 including a main mixer 522 and a second fuel injector 524. The secondary combustion chamber 530 includes a forward wall 532, an aft wall 534, and an axial wall 536 that extends generally axially from the forward wall 532 to the axial wall 536. One or more secondary combustion chamber air holes 540 are disposed through the forward wall 532, the aft wall 534, and/or the axial wall 536. Similar to the combustor 200 of FIG. 2, the annular dome 510 is a wrapped annular dome such that the forward wall 532 and the axial wall 536 are defined by the annular dome 510. The annular dome 510 also includes one or more annular dome air holes 513. The secondary combustion chamber 530 also includes one or more combustion air holes 544 disposed through the aft wall 534.

In this way, the annular dome 510 and the secondary combustion chamber 530 are similar to the annular dome 210 and the secondary combustion chamber 230 of FIG. 2. The position and the location of the plurality of second mixing assemblies 520, however, are different from the position and the location of the plurality of second mixing assemblies 220 of FIG. 2.

The pilot mixer 514 is positioned through the annular dome 510 similar to the pilot mixer 214 of FIG. 2. In this way, the pilot mixer 514 injects a pilot fuel stream 560 and a first portion 562 of the compressed air 65 at a pilot mixer fuel-air mixture angle with respect to the longitudinal centerline axis 201, as detailed above. The pilot mixer 514 includes a pilot mixer air swirler 515 that swirls the first portion 562 of the compressed air 65 to generate a main combustion chamber swirl air flow 569 within a first recirculation zone 502*a* in the main combustion chamber 202. A majority (e.g., greater than 50%) of the first recirculation zone 502*a* is radially inward of the longitudinal centerline axis 201, as detailed above.

The main mixer 522 is positioned through the forward wall 532 (e.g., through the annular dome 510) of the secondary combustion chamber 530 radially outward of the pilot mixer 514. In this way, the main mixer 522 injects a main fuel stream 570 and a second portion 572 of the compressed air 65 at a main mixer fuel-air mixture angle with respect to the longitudinal centerline axis 201. The main mixer fuel-air mixture angle is less than 90° such that the main mixer 522 injects the main fuel stream 570 and the second portion 572 of the compressed air 65 axially aftward and radially inwards and towards the longitudinal centerline axis 201 within the secondary combustion chamber 530. The main mixer 522 includes a second mixing assembly air swirler 525 that swirls the second portion 572 of the compressed air 65 to generate a secondary combustion chamber swirl air flow 542 within a second recirculation zone 502*b* in the secondary combustion chamber 530. An entirety (e.g., 100%) of the second recirculation zone 502*b* is radially outward of the longitudinal centerline axis 201. The main mixer 522 is positioned radially outward of the pilot mixer 514 such that the combustor 500 provides for radial fuel staging between the main mixer 522 and the pilot mixer 514.

The one or more combustion air holes 544 operably direct the compressed air 65 through the aft wall 534 and into the secondary combustion chamber 530 to provide additional air in the combustion process within the secondary combustion chamber 530. The axial wall 536 is angled at the second angle β such that the one or more combustion air holes 544 operably direct the compressed air 65 axially forward through the aft wall 534 at a combustion air hole angle with respect to the longitudinal centerline axis 201.

Figure 6:
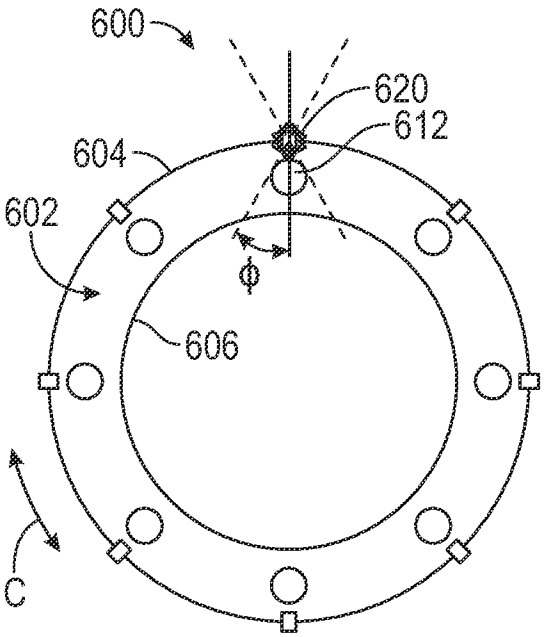
FIG. 6 is a schematic front view of a combustor, according to another embodiment.

FIG. 6 is a schematic front view of a combustor 600, according to another embodiment. The combustor 600 is substantially similar to the combustor 200 of FIG. 2. For example, the combustor 600 includes a combustion chamber 602, an outer liner 604, an inner liner 606, a plurality of first mixing assemblies 612, and a plurality of second mixing assemblies 620. The plurality of second mixing assemblies 620 are oriented at a third angle ϕ with respect to the circumferential direction C. As shown by the dashed lines, the third angle ϕ can be positive or negative such that the plurality of second mixing assemblies 620 injects the fuel at the third angle ϕ with respect to the circumferential direction C. The third angle ϕ is in a range from −80° to 80°. Such a range of the third angle ϕ provides for greater mixing of the combustion gases generated by the plurality of second mixing assemblies 620 and the combustion gases generated by the plurality of first mixing assemblies 612 as compared to values of the third angle ¢ that are outside (e.g., greater than or less than) the range.

Circumferentially successive first mixing assemblies 612 of the plurality of first mixing assemblies 612 can include swirl directions that are co-rotating such that all of the first mixing assemblies 612 produce a main combustion chamber swirl air flow in the same direction. In some embodiments, circumferentially successive first mixing assemblies 612 of the plurality of first mixing assemblies 612 can include swirl directions that are counter-rotating such that a pair of the first mixing assemblies 612 produce main combustion chamber swirl air flows that are counter-rotating to each other. Such patterns of the swirl directions can be utilized by any of the combustors detailed herein.

Circumferentially successive second mixing assemblies 620 of the plurality of second mixing assemblies 620 can include swirl directions that are co-rotating such that all of the second mixing assemblies 620 produce a main combustion chamber swirl air flow in the same direction. In some embodiments, circumferentially successive second mixing assemblies 620 of the plurality of second mixing assemblies 620 can include swirl directions that are counter-rotating such that a pair of the second mixing assemblies 620 produce main combustion chamber swirl air flows that are counter-rotating to each other. Such patterns of the swirl directions can be utilized by any of the combustors detailed herein.

Figure 7:
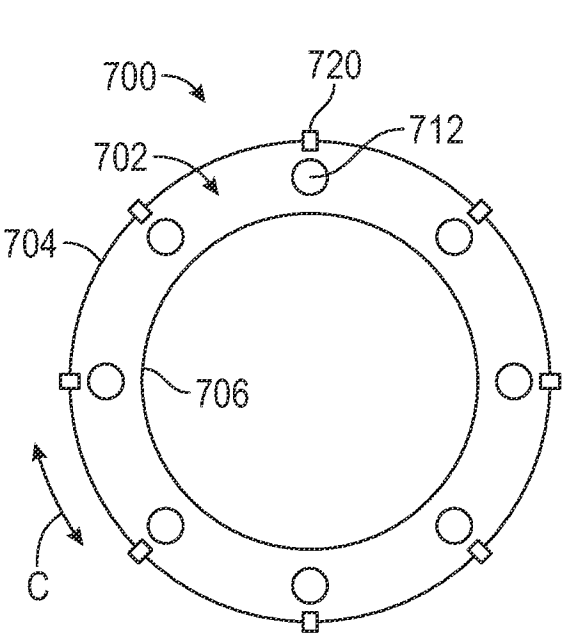
FIG. 7 is a schematic front view of a combustor, according to another embodiment.

FIG. 7 is a schematic front view of a combustor 700, according to another embodiment. The combustor 700 is substantially similar to the combustor 200 of FIG. 2. For example, the combustor 700 includes a combustion chamber 702, an outer liner 704, an inner liner 706, a plurality of first mixing assemblies 712, and a plurality of second mixing assemblies 720. As shown in FIG. 7, the plurality of first mixing assemblies 712 and the plurality of second mixing assemblies 720 are circumferentially aligned about the circumferential direction C. Aligning the plurality of first mixing assemblies 712 and the plurality of second mixing assemblies 720 circumferentially allows the combustion gases generated by the plurality of first mixing assemblies 712 to mix with the combustion gases generated by the plurality of second mixing assemblies 720 for a complete reaction prior to exiting the combustion chamber 702.

Figure 8:
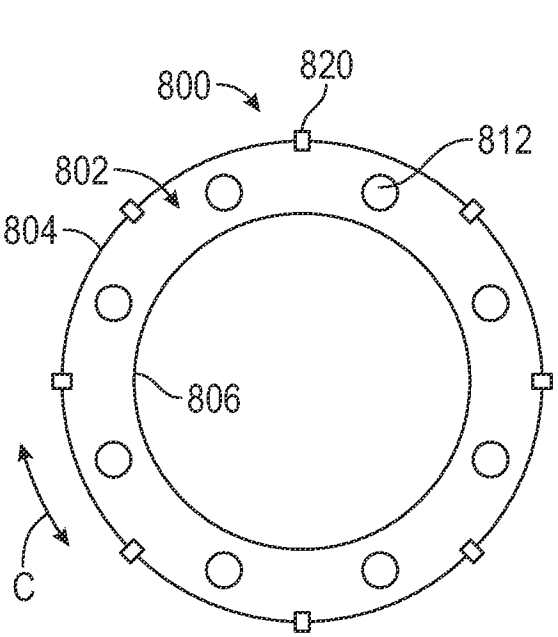
FIG. 8 is a schematic front view of a combustor, according to another embodiment.

FIG. 8 is a schematic front view of a combustor 800, according to another embodiment. The combustor 800 is substantially similar to the combustor 200 of FIG. 2. For example, the combustor 800 includes a combustion chamber 802, an outer liner 804, an inner liner 806, a plurality of first mixing assemblies 812, and a plurality of second mixing assemblies 820. As shown in FIG. 8, the plurality of first mixing assemblies 812 and the plurality of second mixing assemblies 820 are circumferentially misaligned about the circumferential direction C. Misaligning the plurality of first mixing assemblies 812 and the plurality of second mixing assemblies 820 circumferentially reduces the interaction of the plurality of first mixing assemblies 812 and the plurality of second mixing assemblies 820 so the combustion process of the plurality of second mixing assemblies 820 does not interfere with the combustion process of the plurality of second mixing assemblies 820.

Figure 9:
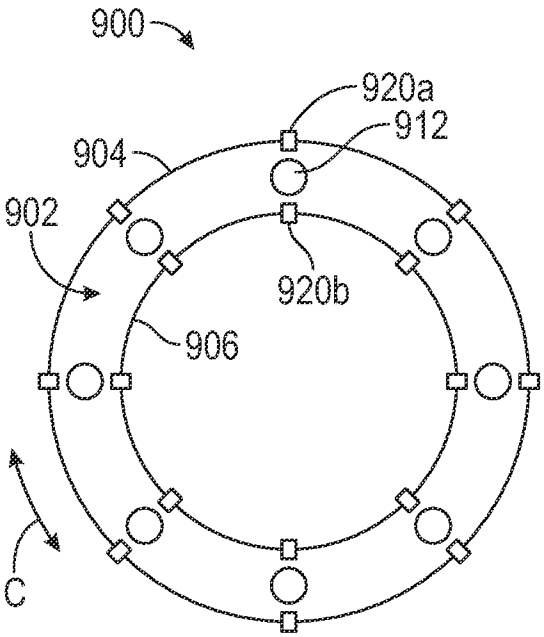
FIG. 9 is a schematic front view of a combustor, according to another embodiment.

FIG. 9 is a schematic front view of a combustor 900, according to another embodiment. The combustor 900 is substantially similar to the combustor 200 of FIG. 2. For example, the combustor 900 includes a combustion chamber 902, an outer liner 904, an inner liner 906, a plurality of first mixing assemblies 912, a first plurality of second mixing assemblies 920*a*, and a second plurality of second mixing assemblies 920*b*. As shown in FIG. 9, the plurality of first mixing assemblies 912, the first plurality of second mixing assemblies 920*a*, and the second plurality of second mixing assemblies 920*b* are circumferentially aligned about the circumferential direction C.

Figure 10:
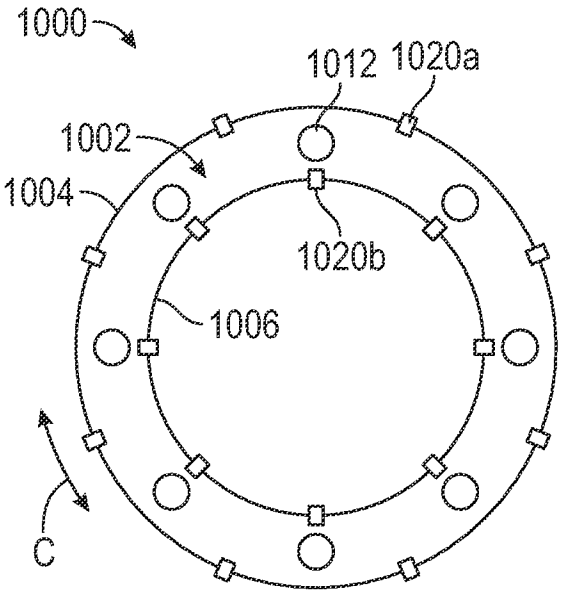
FIG. 10 is a schematic front view of a combustor, according to another embodiment.

FIG. 10 is a schematic front view of a combustor 1000, according to another embodiment. The combustor 1000 is substantially similar to the combustors 200 of FIG. 2. For example, the combustor 1000 includes a combustion chamber 1002, an outer liner 1004, an inner liner 1006, a plurality of first mixing assemblies 1012, a first plurality of second mixing assemblies 1020*a*, and a second plurality of second mixing assemblies 1020*b*. As shown in FIG. 10, the plurality of first mixing assemblies 1012 and the second plurality of second mixing assemblies 1020*b* are circumferentially aligned about the circumferential direction C, while the first plurality of second mixing assemblies 1020*a* are circumferentially misaligned with the first mixing assemblies 1012 and the second plurality of second mixing assemblies 1020*b*.

Figure 11:
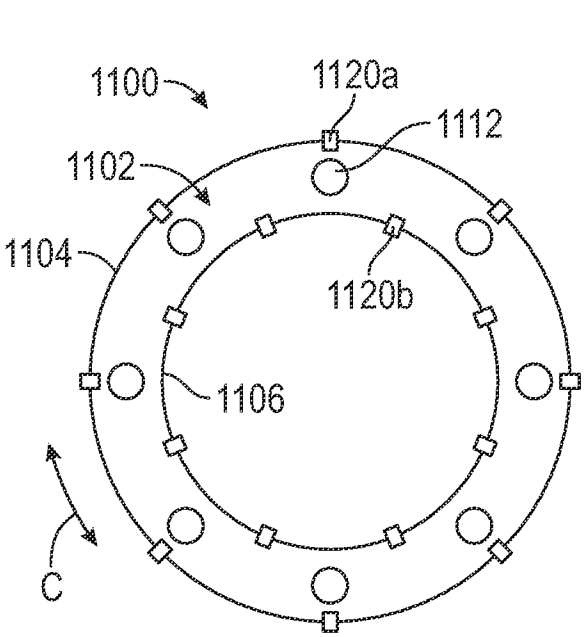
FIG. 11 is a schematic front view of a combustor, according to another embodiment.

FIG. 11 is a schematic front view of a combustor 1100, according to another embodiment. The combustor 1100 is substantially similar to the combustor 200 of FIG. 2. For example, the combustor 1100 includes a combustion chamber 1102, an outer liner 1104, an inner liner 1106, a plurality of first mixing assemblies 1112, a first plurality of second mixing assemblies 1120*a*, and a second plurality of second mixing assemblies 1120*b*. As shown in FIG. 11, the plurality of first mixing assemblies 1112 and the first plurality of second mixing assemblies 1120*a* are circumferentially aligned about the circumferential direction C, while the second plurality of second mixing assemblies 1120*b* are circumferentially misaligned with the first mixing assemblies 1112 and the first plurality of second mixing assemblies 1120*a*.

The embodiments detailed herein provide for a multi-staged combustor including radial staging and axial staging combined with one or more secondary combustion chambers that inject combustion gases downstream of a first recirculation zone, thereby, providing for improved stoichiometric capabilities in the combustor, while reducing NOx emissions, across the entire mission operating cycle of a turbine engine. The one or more secondary combustion chambers include a plurality of second mixing assemblies that produces a second recirculation zone in the one or more secondary combustion chambers. The plurality of first mixing assemblies is disposed to generate the first recirculation zone at a pilot mixer fuel-air mixture angle, and the plurality of second mixing assemblies is disposed to generate the second recirculation zone at a main mixer fuel-air mixture angle such that the first recirculation zone and the second recirculation zone include a radial vector and an axial vector. Accordingly, the embodiments disclosed herein provide for greater NOx reductions, while allowing for leaner fuel-air ratios to the pilot mixer and the main mixer, as compared to combustors without the benefit of the present disclosure. Further, the multi-staged combustor detailed herein allows the stoichiometry of the combustion process within the combustor to be balanced for operability, while also reducing NOx emissions. The angled annular dome helps to improve the interaction and mixing of the fuel and the air and of the combustion gases between the forward stage and the aft stage.

Further aspects of the present disclosure are provided by the subject matter of the following clauses.

A turbine engine comprises a combustor comprising, a main combustion chamber including an outer liner and an inner liner, the main combustion chamber defining a radial direction, an axial direction, and a circumferential direction, and the main combustion chamber including a longitudinal centerline axis, an annular dome coupled to the outer liner and the inner liner at a forward end of the main combustion chamber, the annular dome positioned at a first angle $\alpha$ with respect to the longitudinal centerline axis, and a secondary combustion chamber formed in at least one of the outer liner or the inner liner, the secondary combustion chamber defined by a portion of the annular dome and an aft wall positioned at a second angle $\beta$ with respect to the longitudinal centerline axis, a plurality of first mixing assemblies each having a pilot mixer, the plurality of first mixing assemblies disposed through the annular dome, the pilot mixer operably injecting a pilot mixer fuel-air mixture axially aft at a pilot mixer fuel-air mixture angle with respect to the longitudinal centerline axis into the main combustion chamber and generating a first recirculation zone within the main combustion chamber, and a plurality of second mixing assemblies each having a main mixer, the plurality of second mixing assemblies disposed through the annular dome or the aft wall at the secondary combustion chamber, the main mixer operably injecting a main mixer fuel-air mixture at a main mixer fuel-air mixture angle into the secondary combustion chamber to produce combustion gases and to generate a second recirculation zone within the secondary combustion chamber, and the secondary combustion chamber operably injecting the combustion gases into the main combustion chamber.

The turbine engine of the preceding clause, the plurality of first mixing assemblies including a first mixing assembly air swirler, the first mixing assembly air swirler operably swirling compressed air and generating the first recirculation zone within the main combustion chamber.

The turbine engine of any preceding clause, the plurality of second mixing assemblies including one or more second mixing assembly air swirlers, the one or more second mixing assembly air swirlers operably swirling compressed air and generating the second recirculation zone within the secondary combustion chamber.

The turbine engine of any preceding clause, further comprising a fuel system that operably provides fuel splits to the pilot mixer and the main mixer such that the pilot mixer is fuel-rich and the main mixer is fuel-lean.

The turbine engine of any preceding clause, the fuel system operably providing the fuel to the pilot mixer and the main mixer such that the pilot mixer or the pilot mixer and the main mixer operate at low power operation of the turbine engine, and the pilot mixer and the main mixer operate at a mid-level power operation or a high power operation of the turbine engine.

The turbine engine of any preceding clause, the pilot mixer injecting the pilot mixer fuel-air mixture into the main combustion chamber at the pilot mixer fuel-air mixture angle such that the pilot mixer fuel-air mixture includes an axial vector and a radial vector The turbine engine of any preceding clause, the main mixer injecting the main mixer fuel-air mixture into the secondary combustion chamber at the main mixer fuel-air mixture angle such that the main mixer fuel-air mixture includes an axial vector and a radial vector.

The turbine engine of any preceding clause, the first angle $\alpha$ being greater than 0° and less than 90° or greater than 90° and less than 180°.

The turbine engine of any preceding clause, the secondary combustion chamber including a forward wall defined by the annular dome, an aft wall, and an axial wall that extends from the forward wall to the aft wall, the annular dome defining the axial wall.

The turbine engine of any preceding clause, the aft wall being angled at the second angle $\beta$, and the second angle $\beta$ being greater than 0° and less than 90° or greater than 90° and less than 180°.

The turbine engine of any preceding clause, the annular dome defining the axial wall of the secondary combustion chamber.

The turbine engine of any preceding clause, the secondary combustion chamber including one or more air holes that operably direct compressed air into the secondary combustion chamber to cool the forward wall, the aft wall, and/or the axial wall.

The turbine engine of any preceding clause, the pilot mixer fuel-air mixture being ignited to generate a pilot flame within the first recirculation zone.

The turbine engine of any preceding clause, the main mixer fuel-air mixture being ignited to generate a main flame within the second recirculation zone of the secondary combustion chamber.

The turbine engine of any preceding clause, the pilot flame producing combustion gases within the first recirculation zone.

The turbine engine of any preceding clause, the main combustion chamber operably directing the combustion gases from the first recirculation zone downstream to mix with the combustion gases from the secondary combustion chamber within the main combustion chamber.

The turbine engine of any preceding clause, the main combustion chamber extending from the annular dome to a main combustion chamber outlet.

The turbine engine of any preceding clause, the annular dome being a wrapped annular dome that forms the axial wall of the secondary combustion chamber.

The turbine engine of the preceding clause, the wrapped annular dome being coupled to the inner liner and the aft wall by one or more annular dome joints.

The turbine engine of any preceding clause, the annular dome being a bulkhead annular dome that is coupled to the inner liner and to the axial wall by one or more annular dome joints.

The turbine engine of any preceding clause, the plurality of first mixing assemblies being spaced circumferentially about the annular dome.

The turbine engine of any preceding clause, further comprising a plurality of first fuel injectors each coupled in flow communication with a respective first mixing assembly.

The turbine engine of any preceding clause, the plurality of second mixing assemblies being spaced circumferentially about the outer liner or the inner liner.

The turbine engine of any preceding clause, further comprising a plurality of second fuel injectors each coupled in flow communication with a respective second mixing assembly.

The turbine engine of any preceding clause, the low power operation being less than 30% of sea level static (SLS) maximum engine rated thrust.

The turbine engine of any preceding clause, the mid-level power operation being from 30% to 85% of the SLS maximum engine rated thrust.

The turbine engine of any preceding clause, the high power operation being greater than 85% of the SLS maximum engine rated thrust.

The turbine engine of any preceding clause, the plurality of mixing assemblies swirling the pilot mixer fuel-air mixture in a first swirl direction.

The turbine engine of any preceding clause, the main mixer swirling the main mixer fuel-air mixture in a second swirl direction.

The turbine engine of any preceding clause, the second swirl direction being the same as the first swirl direction.

The turbine engine of any preceding clause, the second swirl direction being different from the first swirl direction.

The turbine engine of any preceding clause, the combustor operably directing a first portion of compressed air to the pilot mixer, and a second portion of compressed air to the main mixer.

The turbine engine of any preceding clause, the pilot mixer generating a pilot fuel stream such that the pilot fuel-air mixture is fuel-rich, and the main mixer generating a main fuel stream such that the main mixer fuel-air mixture is fuel-lean.

The turbine engine of any preceding clause, the pilot fuel stream including 95% to 100% of the fuel during idle conditions, approach conditions, and cruise conditions of the turbine engine, and 65% to 80% of the fuel during climb conditions and take-off conditions of the turbine engine.

The turbine engine of any preceding clause, the main fuel stream including 0% to 5% of the fuel during idle conditions, approach conditions, and cruise conditions of the turbine engine, and 20% to 35% of the fuel during climb conditions and take-off conditions.

The turbine engine of any preceding clause, the pilot fuel stream including 80% to 100% of the fuel during idle conditions, 40% to 100% of the fuel during approach conditions, and 15% to 50% of the fuel during cruise conditions, climb conditions, and take-off conditions.

The turbine engine of any preceding clause, the main fuel stream including 0% to 20% of the fuel during idle conditions, 0% to 60% of the fuel during approach conditions, and 50% to 85% cruise conditions, climb conditions, and take-off conditions.

The turbine engine of any preceding clause, the combustor operably directing the compressed air through the annular dome, through the outer liner and the inner liner in an area forward of the plurality of second mixing assemblies, and through the outer liner and the inner liner in an area aft of the plurality of second mixing assemblies.

The turbine engine of any preceding clause, the combustor operably directing 5% to 9% of the compressed air to the annular dome, 35% to 50% of the compressed air to one or more combustion air holes on the outer liner or the inner liner, 7% to 10% of the compressed air to the outer liner and the inner liner in the area forward of the plurality of second mixing assemblies, and 6% to 9% of the compressed air to the outer liner and the inner liner in an area aft of the plurality of second mixing assemblies.

The turbine engine of any preceding clause, the combustor operably directing 5% to 9% of the compressed air to the annular dome, 5% to 15% of the compressed air to one or more dilution holes on the outer liner or the inner liner, 7% to 9% of the compressed air to the outer liner and the inner liner in the area forward of the plurality of second mixing assemblies, and 7% to 9% of the compressed air to the outer liner and the inner liner in an area aft of the plurality of second mixing assemblies.

The turbine engine of any preceding clause, the annular dome including one or more annular dome air holes to provide the compressed air through the annular dome into the combustion chamber.

The turbine engine of any preceding clause, the outer liner including one or more liner air holes to provide the compressed air through the outer liner into the combustion chamber.

The turbine engine of any preceding clause, the inner liner including one or more liner air holes to provide the compressed air through the outer liner into the combustion chamber.

The turbine engine of any preceding clause, the plurality of first mixing assemblies and the plurality of second mixing assemblies being circumferentially aligned about the circumferential direction.

The turbine engine of any preceding clause, the plurality of first mixing assemblies and the plurality of second mixing assemblies being circumferentially misaligned about the circumferential direction.

The turbine engine of any preceding clause, the plurality of second mixing assemblies including a first plurality of mixing assemblies on the outer liner and a second plurality of second mixing assemblies on the inner liner.

The turbine engine of any preceding clause, the plurality of first mixing assemblies, the first plurality of second mixing assemblies, and the second plurality of second mixing assemblies being circumferentially aligned about the circumferential direction.

The turbine engine of any preceding clause, the plurality of first mixing assemblies and the second plurality of second mixing assemblies being circumferentially aligned about the circumferential direction, and the first plurality of second mixing assemblies being circumferentially misaligned about the circumferential direction with the plurality of first mixing assemblies and the second plurality of second mixing assemblies.

The turbine engine of any preceding clause, the plurality of first mixing assemblies and the first plurality of second mixing assemblies being circumferentially aligned about the circumferential direction, and the second plurality of second mixing assemblies being circumferentially misaligned about the circumferential direction with the plurality of first mixing assemblies and the first plurality of second mixing assemblies.

The turbine engine of any preceding clause, the main mixer being disposed at an angle $\phi$ with respect to the circumferential direction, the angle ¢ being in a range from −80° to 80°.

The turbine engine of any preceding clause, the secondary combustion chamber including one or more combustion air holes that operably direct compressed air into the secondary combustion chamber for additional air for combustion.

The turbine engine of any preceding clause, the one or more combustion air holes being positioned on the forward wall.

The turbine engine of any preceding clause, the one or more combustion air holes being positioned on the aft wall.

The turbine engine of any preceding clause, the outer liner and/or the inner liner including one or more liner combustion air holes that operably direct compressed air into the main combustion chamber for additional air for combustion.

The turbine engine of any preceding clause, the main mixer being disposed through the aft wall and operably injecting the main mixer fuel-air mixture axially forward into the secondary combustion chamber.

The turbine engine of any preceding clause, the main mixer being disposed through the forward wall and operably injecting the main mixer fuel-air mixture axially aft into the secondary combustion chamber.

The turbine engine of any preceding clause, the main mixer being disposed through the axial wall and operably injecting the main mixer fuel-air mixture radially into the secondary combustion chamber.

The turbine engine of any preceding clause, the secondary combustion chamber including one or more secondary combustion chamber air holes disposed in at least one of the forward wall, the aft wall, or the axial wall for cooling the forward wall, the aft wall, or the axial wall.

The turbine engine of any preceding clause, the one or more combustion air holes being larger than the one or more secondary combustion chamber air holes.

The turbine engine of any preceding clause, the pilot mixer being disposed through the annular dome such that a majority of the first recirculation zone is radially inward of the longitudinal centerline axis of the main combustion chamber.

The turbine engine of any preceding clause, the main mixer being disposed through the secondary combustion chamber such that an entirety of the second recirculation zone is radially outward of the longitudinal centerline axis of the main combustion chamber.

The turbine engine of any preceding clause, circumferentially successive first mixing assemblies of the plurality of first mixing assemblies including swirl directions that are co-rotating such that all of the first mixing assemblies produce a main combustion chamber swirl air flow in the same direction.

The turbine engine of any preceding clause, circumferentially successive first mixing assemblies of the plurality of first mixing assemblies including swirl directions that are counter-rotating such that a pair of the first mixing assemblies produce main combustion chamber swirl air flows that are counter-rotating to each other.

The turbine engine of any preceding clause, circumferentially successive second mixing assemblies of the plurality of second mixing assemblies including swirl directions that are co-rotating such that all of the second mixing assemblies produce a secondary combustion chamber swirl air flow in the same direction.

The turbine engine of any preceding clause, circumferentially successive second mixing assemblies of the plurality of second mixing assemblies including swirl directions that are counter-rotating such that a pair of the second mixing assemblies produce secondary combustion chamber swirl air flows that are counter-rotating to each other.

A combustor for a turbine engine, the turbine engine being the turbine engine of any preceding clause.

A method of operating the turbine engine of any preceding clause, the method comprising generating the pilot mixer fuel-air mixture with the pilot mixer, injecting the pilot mixer fuel-air mixture axially at the pilot mixer fuel-air mixture angle into the main combustion chamber and generating the first recirculation zone to generate a pilot flame that produces combustion gases within the first recirculation zone, generating the main mixer fuel-air mixture with the main mixer, injecting the main mixer fuel-air mixture at the main mixer fuel-air mixture angle into the secondary combustion chamber and generating the second recirculation zone to generate a main flame that produces combustion gases within the secondary combustion chamber, and injecting the combustion gases from the secondary combustion chamber into the main combustion chamber downstream of the first recirculation zone.

The method of the preceding clause, further comprising operably directing the combustion gases in the first recirculation zone downstream from the first recirculation zone, and mixing the combustion gases from the first recirculation zone with the combustion gases from the secondary combustion chamber in the main combustion chamber.

The method of any preceding clause, further comprising operably directing a first portion of compressed air to the pilot mixer and a second portion of compressed air to the main mixer.

The method of any preceding clause, further comprising generating a pilot fuel stream with the pilot mixer such that the pilot mixer fuel-air mixture is fuel-rich, and generating a main fuel stream with the main mixer such that the main mixer fuel-air mixture is fuel-lean.

The method of any preceding clause, further comprising providing, with a fuel system, fuel splits to the pilot mixer and the main mixer.

The method of any preceding clause, further comprising swirling compressed air with a first mixing assembly air swirler to generate the first recirculation zone.

The method of any preceding clause, further comprising swirling compressed air with a second mixing assembly air swirler to generate the second recirculation zone.

The method of any preceding clause, further comprising operating the pilot mixer and the main mixer during a mid-level power operation or a high power operation of the turbine engine.

The method of any preceding clause, further comprising operating the pilot mixer during a low power operation of the turbine engine.

The method of any preceding clause, further comprising operating the pilot mixer and the main mixer during a low power operation of the turbine engine.

The method of any preceding clause, the turbine engine being the turbine engine of any preceding clause.

Although the foregoing description is directed to the preferred embodiments of the present disclosure, other variations and modifications will be apparent to those skilled in the art and may be made without departing from the spirit or the scope of the disclosure. Moreover, features described in connection with one embodiment of the present disclosure may be used in conjunction with other embodiments, even if not explicitly stated above.

The invention claimed is:

1. A turbine engine comprising:

a combustor comprising:

a main combustion chamber including an outer liner and an inner liner, the main combustion chamber defining a radial direction, an axial direction, and a circumferential direction, and the main combustion chamber including a longitudinal centerline axis;

an annular dome coupled to the outer liner and the inner liner at a forward end of the main combustion chamber, the annular dome positioned at a first angle $\alpha$ with respect to the longitudinal centerline axis; and a secondary combustion chamber formed in at least one of the outer liner or the inner liner, the secondary combustion chamber defined by a portion of the annular dome and an aft wall extending radially outward from the outer liner, the aft wall angled such that a radially outer end of the aft wall is axially forward of a radially inner end of the aft wall opposite the radially outer end, the aft wall being positioned at a second angle $\beta$ with respect to the longitudinal centerline axis wherein the second angle $\beta$ is greater than 90° and less than 180°;

a plurality of first mixing assemblies each having a pilot mixer, the plurality of first mixing assemblies disposed through the annular dome, the pilot mixer operably injecting a pilot mixer fuel-air mixture axially aft at a pilot mixer fuel-air mixture angle with respect to the longitudinal centerline axis into the main combustion chamber and generating a first recirculation zone within the main combustion chamber; and a plurality of second mixing assemblies each having a main mixer, the plurality of second mixing assemblies disposed through, and perpendicular with, the aft wall at the secondary combustion chamber, the main mixer operably injecting a main mixer fuel-air mixture in an axially forward direction and at a main mixer fuel-air mixture angle that is angled radially inward with respect to the longitudinal centerline axis into the secondary combustion chamber to produce combustion gases and to generate a second recirculation zone within the secondary combustion chamber, and the secondary combustion chamber operably injecting the combustion gases into the main combustion chamber.

2. The turbine engine of claim 1, wherein the plurality of first mixing assemblies includes a first mixing assembly air swirler, the first mixing assembly air swirler operably swirling compressed air and generating the first recirculation zone within the main combustion chamber.

3. The turbine engine of claim 1, wherein the plurality of second mixing assemblies includes one or more second mixing assembly air swirlers, the one or more second mixing assembly air swirlers operably swirling compressed air and generating the second recirculation zone within the secondary combustion chamber.

4. The turbine engine of claim 1, wherein the pilot mixer injects the pilot mixer fuel-air mixture into the main combustion chamber at the pilot mixer fuel-air mixture angle such that the pilot mixer fuel-air mixture includes an axial vector and a radial vector.

5. The turbine engine of claim 1, wherein the main mixer injects the main mixer fuel-air mixture into the secondary combustion chamber at the main mixer fuel-air mixture angle such that the main mixer fuel-air mixture includes an axial vector and a radial vector.

6. The turbine engine of claim 1, wherein the secondary combustion chamber includes a forward wall defined by the annular dome, the aft wall, and an axial wall that extends from the forward wall to the aft wall, the annular dome defining the axial wall.

7. The turbine engine of claim 1, wherein the first angle $\alpha$ is greater than 0° and less than 90° or greater than 90° and less than 180°.

8. The turbine engine of claim 1, further comprising a fuel system that operably provides fuel splits to the pilot mixer and the main mixer such that the pilot mixer is fuel-rich and the main mixer is fuel-lean.

9. The turbine engine of claim 8, wherein the fuel system operably provides the fuel to the pilot mixer and the main mixer such that the pilot mixer or the pilot mixer and the main mixer operate at low power operation of the turbine engine, and the pilot mixer and the main mixer operate at a mid-level power operation or a high power operation of the turbine engine.

10. A method of operating the turbine engine of claim 1, the method comprising:

generating the pilot mixer fuel-air mixture with the pilot mixer;

injecting the pilot mixer fuel-air mixture axially at the pilot mixer fuel-air mixture angle into the main combustion chamber and generating the first recirculation zone to generate a pilot flame that produces combustion gases within the first recirculation zone;

generating the main mixer fuel-air mixture with the main mixer;

injecting the main mixer fuel-air mixture at the main mixer fuel-air mixture angle into the secondary combustion chamber and generating the second recirculation zone to generate a main flame that produces combustion gases within the secondary combustion chamber; and injecting the combustion gases from the secondary combustion chamber into the main combustion chamber downstream of the first recirculation zone.

11. The method of claim 10, further comprising operably directing the combustion gases in the first recirculation zone downstream from the first recirculation zone, and mixing the combustion gases from the first recirculation zone with the combustion gases from the secondary combustion chamber in the main combustion chamber.

12. The method of claim 10, further comprising operably directing a first portion of compressed air to the pilot mixer and a second portion of compressed air to the main mixer.

13. The method of claim 10, further comprising generating a pilot fuel stream with the pilot mixer such that the pilot mixer fuel-air mixture is fuel-rich, and generating a main fuel stream with the main mixer such that the main mixer fuel-air mixture is fuel-lean.

14. The method of claim 10, further comprising providing, with a fuel system, fuel splits to the pilot mixer and the main mixer.

15. The method of claim 10, further comprising swirling compressed air with a first mixing assembly air swirler to generate the first recirculation zone.

16. The method of claim 10, further comprising swirling compressed air with a second mixing assembly air swirler to generate the second recirculation zone.

17. The method of claim 10, further comprising operating the pilot mixer and the main mixer during a mid-level power operation or a high power operation of the turbine engine.

18. The method of claim 17, further comprising operating the pilot mixer during a low power operation of the turbine engine.

19. The method of claim 17, further comprising operating the pilot mixer and the main mixer during a low power operation of the turbine engine.

20. The turbine engine of claim 1, wherein greater than 50% of the first recirculation zone within the main combustion chamber is radially inward of the longitudinal centerline axis.

* * * * *